US007191482B2

(12) United States Patent
Romano et al.

(10) Patent No.: US 7,191,482 B2
(45) Date of Patent: Mar. 20, 2007

(54) PATIENT SUPPORT

(75) Inventors: James J. Romano, James Island, SC (US); Sohrab Soltani, Charleston, SC (US); Michael V. Bolden, Charleston, SC (US)

(73) Assignee: Hill Rom Services, Inc., Wilmington, DE (US)

( * ) Notice: Subject to any disclaimer, the term of this patent is extended or adjusted under 35 U.S.C. 154(b) by 16 days.

(21) Appl. No.: 10/800,952

(22) Filed: Mar. 15, 2004

(65) Prior Publication Data

US 2004/0237203 A1 Dec. 2, 2004

Related U.S. Application Data

(60) Continuation-in-part of application No. 10/793,723, filed on Mar. 5, 2004, and a continuation of application No. 09/921,317, filed on Aug. 2, 2001, now Pat. No. 6,701,556, and a division of application No. 09/306,601, filed on May 6, 1999, now Pat. No. 6,269,504.

(60) Provisional application No. 60/454,978, filed on Mar. 14, 2003, provisional application No. 60/084,411, filed on May 6, 1998.

(51) Int. Cl.
*A47C 27/10* (2006.01)

(52) U.S. Cl. ..... 5/714; 5/713; 5/952

(58) Field of Classification Search ..... 5/710–715, 5/952

See application file for complete search history.

(56) References Cited

U.S. PATENT DOCUMENTS 371,938 A 10/1887 Hinsdill
2,029,370 A 2/1936 Heldenbrand
2,742,652 A 4/1956 Mautz
3,000,020 A 9/1961 Lombard et al.
3,030,145 A 4/1962 Kottemann
3,047,888 A 8/1962 Shecter et al.
3,080,578 A 3/1963 Novascone
3,268,922 A 8/1966 Moxley
3,421,163 A 1/1969 Stoughton
3,580,615 A 5/1971 Prosser
3,939,508 A 2/1976 Hall et al.
3,974,532 A 8/1976 Ecchuya
4,347,633 A 9/1982 Gammons et al.
4,449,261 A 5/1984 Magnusson
4,485,505 A 12/1984 Paul
4,486,909 A 12/1984 McKneelan
4,494,775 A 1/1985 Nash et al.
4,522,447 A 6/1985 Snyder et al.
4,555,130 A 11/1985 McClain
4,580,301 A 4/1986 Ludman et al.
4,631,221 A 12/1986 Disselbeck et al.
4,638,519 A 1/1987 Hess
4,706,313 A 11/1987 Murphy (Continued)

FOREIGN PATENT DOCUMENTS

BE 885296 1/1981

(Continued)

*Primary Examiner*—Alexander Grosz
(74) *Attorney, Agent, or Firm*—Bose McKinney & Evans LLP

(57) ABSTRACT

A patient support is disclosed including a spacing structure and a base portion.

39 Claims, 13 Drawing Sheets

U.S. PATENT DOCUMENTS 4,753,480 A 6/1988 Morell
4,777,681 A 10/1988 Luck et al.
4,788,730 A 12/1988 Bexton
4,796,948 A 1/1989 Paul et al.
4,803,744 A 2/1989 Peck et al.
4,825,488 A 5/1989 Bedford
4,890,877 A 1/1990 Ashtiani-Zarandi et al.
4,896,389 A 1/1990 Chamberland
4,900,065 A 2/1990 Houck
4,930,173 A 6/1990 Woller
4,947,500 A 8/1990 Seiler
4,949,412 A 8/1990 Goode
4,951,334 A 8/1990 Maier
5,002,336 A 3/1991 Feher
5,029,352 A 7/1991 Hargest et al.
5,039,567 A 8/1991 Landi et al.
5,051,673 A 9/1991 Goodwin
5,085,487 A 2/1992 Weingartner et al.
5,088,747 A 2/1992 Morrison et al.
5,107,558 A 4/1992 Luck
5,111,544 A 5/1992 Graebe
5,121,513 A 6/1992 Thomas et al.
5,182,826 A 2/1993 Thomas et al.
5,191,664 A 3/1993 Wyatt
5,201,780 A 4/1993 Dinsmoor, III et al.
5,231,717 A 8/1993 Scott et al.
5,243,722 A 9/1993 Gusakov
5,243,723 A 9/1993 Cotner et al.
5,255,404 A 10/1993 Dinsmoor, III et al.
5,259,079 A 11/1993 Visser et al.
5,267,364 A 12/1993 Volk
5,269,030 A 12/1993 Pahno et al.
5,294,181 A 3/1994 Rose et al.
5,311,623 A 5/1994 Hendi
5,323,500 A 6/1994 Roe et al.
5,325,551 A 7/1994 Tappel et al.
5,364,686 A 11/1994 Disselbeck et al.
5,373,595 A 12/1994 Johnson et al.
5,375,273 A 12/1994 Bodine, Jr. et al.
5,394,576 A 3/1995 Soltani et al.
5,403,065 A 4/1995 Callerio
5,430,901 A 7/1995 Farley
5,442,823 A 8/1995 Siekman et al.
5,454,142 A 10/1995 Neely et al.
5,457,833 A 10/1995 Jay
5,483,709 A 1/1996 Foster et al.
5,513,402 A 5/1996 Schwartz
5,513,899 A 5/1996 Michaels et al.
5,542,136 A 8/1996 Tappel
5,566,409 A 10/1996 Klearman
5,586,346 A 12/1996 Stacy et al.
5,588,167 A 12/1996 Pahno et al.
5,592,707 A 1/1997 Disnmoor, III et al.
5,594,963 A 1/1997 Berkowitz
5,606,764 A 3/1997 Zhou et al.
5,611,096 A 3/1997 Bartlett et al.
5,623,736 A 4/1997 Soltani et al.
5,636,395 A 6/1997 Serda
5,636,397 A 6/1997 Boyd et al.
5,638,564 A 6/1997 Greenawalt et al.
5,647,079 A 7/1997 Hakamiun et al.
5,662,384 A 9/1997 O'Neill et al.
5,666,681 A 9/1997 Meyer et al.
5,671,977 A 9/1997 Jay et al.
5,675,855 A 10/1997 Culp
5,678,265 A 10/1997 Meyer
5,678,891 A 10/1997 O'Neill et al.
5,680,662 A 10/1997 Purdy et al.
5,681,092 A 10/1997 Hanson et al.
5,687,436 A 11/1997 Denton
5,687,438 A 11/1997 Biggie et al.
5,689,845 A 11/1997 Sobieralski
5,729,853 A * 3/1998 Thompson ..... 5/713
5,731,062 A 3/1998 Kim et al.
5,781,949 A 7/1998 Weismiller et al.
5,802,646 A 9/1998 Stolpmann et al.
5,815,865 A 10/1998 Washburn et al.
5,855,415 A 1/1999 Lilley, Jr.
5,865,474 A 2/1999 Takahashi
5,870,785 A 2/1999 Hoorens
5,904,172 A 5/1999 Gifft et al.
5,920,934 A 7/1999 Hannagan et al.
5,926,884 A 7/1999 Biggie et al.
5,966,762 A 10/1999 Wu
6,014,783 A 1/2000 Collier et al.
6,052,851 A 4/2000 Kohnle
6,061,855 A 5/2000 Flick
6,269,504 B1 8/2001 Romano et al.
6,286,167 B1 9/2001 Stolpmann
6,415,814 B1 7/2002 Hand et al.
6,487,739 B1 12/2002 Harker
6,687,937 B2 2/2004 Harker
6,701,556 B2 3/2004 Romano et al.
2002/0073489 A1 6/2002 Totton et al.
2002/0195144 A1 12/2002 Hand et al.
2003/0046762 A1 3/2003 Stolpmann

FOREIGN PATENT DOCUMENTS

CH 332754 11/1958
EP 0 464 692 1/1992
EP 0 606 892 7/1994
FR 2 656 795 7/1991
GB 2 181 048 4/1987
GB 2 225 229 5/1990
GB 2 333 230 7/1999
WO WO 98/36665 8/1998
WO WO 99/49761 10/1999

* cited by examiner

PATIENT SUPPORT

RELATED APPLICATIONS

This patent application is a continuation-in-part of pending U.S. patent application Ser. No. 10/793,723, filed on Mar. 5, 2004, and claims the benefit of U.S. Provisional Patent Application Ser. No. 60/454,978, filed Mar. 14, 2003.

U.S. patent application Ser. No. 10/793,723 is a continuation of U.S. patent application Ser. No. 09/921,317, filed on Aug. 2, 2001, now U.S. Pat. No. 6,701,556; U.S. Patent No. 6,701,556 is a divisional of U.S. patent application Ser. No. 09/306,601, filed on May 6, 1999, now U.S. Pat. No. 6,269,504; U.S. Pat. No. 6,269,504 claims the benefit of U.S. provisional application Ser. No. 60/084,411 filed May 6, 1998.

The disclosures of all the above patents and patent applications are expressly incorporated by reference herein.

BACKGROUND AND SUMMARY OF THE INVENTION

This application further expressly incorporates by reference the disclosure of the following: U.S. Pat. No. 4,949,414 issued Aug. 21, 1990 to Thomas et al. titled "Modular Low Air Loss Patient Support System and Methods for Automatic Patient Turning and Pressure Point Relief," U.S. Pat. No. 5,794,288 issued on Aug. 18, 1998 to Soltani et al. titled "Pressure Control Assembly for an Air Mattress," U.S. Pat. No. 6,212,718 issued on Apr. 10, 2001 to Stolpmann et al. and titled "Air-Over-Foam Mattress," U.S. Pat. No. 6,240,584 issued on Jun. 5, 2001 to Perez et al titled "Mattress Assembly," and U.S. Pat. No. 6,415,814 issued on Jul. 9, 2002 to Barry D. Hand et al. titled "Vibratory Patient Support System," and U.S. patent application Ser. No. 09/701,499, now U.S. Pat. No. 6,582,456 issued on Jun. 24, 2003 to Hand et al. and titled "Heated Patient Support Apparatus." This application additionally expressly incorporates by reference the PrimeAire® Therapy Surface and the SilkAir® Therapy System both sold by Hill-Rom located in Batesville, Ind. and at 4349 Corporate Road, Charleston, S.C. 29405.

The present invention relates generally to patient supports and more specifically patient supports including a spacing structure and an inflatable layer, such as a plurality of air bladders. As used herein, the term spacing structure for convenience is defined to include at least suitable types of "indented fiber layers" and suitable types of "three dimensional engineered materials."

The present invention relates to mattress or cushion structures designed to improve pressure distribution while reducing the overall thickness of the mattress or cushion. The mattress or cushion structures of the present invention illustratively include a foam base on which a spacing structure such as one or more indented fiber layers or other three dimensional engineered material are placed. The base and the spacing structure are illustratively encased in a cover to provide a mattress or cushion.

While the use of foam in mattresses and cushions is known and the use of three dimensional engineered material is known, the present invention relates to a unique combination of a foam base and three dimensional engineered material layers placed on the foam base. The present invention also contemplates that, in addition to the foam base, an air cushion layer may be used with the foam and the indented fiber layers to further enhance the pressure distribution capabilities of the mattress or cushion. In some embodiments, the base may be primarily, if not solely, an air cushion which is enhanced by at least one three dimensional engineered material layer. In other embodiments, water filled bladders, springs, or zones filled with beads, gel or other such material may be used in the base.

Reference is made to U.S. Pat. Nos. 5,731,062 and 5,454,142 disclosing the three dimensional fiber networks made from textile fabrics that have projections and optional depressions which are compressible and return to their original shape after being depressed. U.S. Pat. Nos. 5,731,062 and 5,454,142 are owned by Hoechst Celanese Corporation, Somerville, N.J. Such material is a synthetic thermoplastic fiber network in flexible sheets having projections and/or indentations for use as cushions and/or impact-absorbing components. The descriptions of such patents are incorporated herein by reference to establish the nature of one example of three dimensional engineered material or indented fiber layer disclosed herein. It will be appreciated, however, that the present invention contemplates use of such layers whether or not they are supplied by Hoechst Celanese Corporation and whether or not they are similar to the SPACENET® product.

It is understood that other types of materials similar to the SPACENET® material may be used. For example, the material may be any type of three dimensional engineered material having a spring rate in both the X and Y axes. Preferably such material is open and breathable to provide air passage through the layer. For instance, Model No. 5875, 5886, 5898, and 5882 materials from Müller Textile, a molded thermoplastic spacer matrix material available from Akzo Nobel, or other suitable material may be used. Therefore, the term "three dimensional engineered material" is meant to include any of these types of materials used in accordance with the present invention.

The concept is to use three dimensional fiber layer networks made from textile fibers that have projections and optional depressions or other structures which are compressible and which return to their original shapes after being compressed or the equivalents of such layers. The SPACENET® fiber networks are typically made by thermomechanical deformation of textile fabrics that are in turn made from thermoplastic fibers. In accordance with the present invention other types of layers with individual spring or spring-like protrusions may be used.

It has been found that two or more such layers, hereinafter referred to as "indented fiber layers" for convenience will assist in the pressure distribution when incorporated into an assembly comprising a well designed support base which may comprise foam or some combination of foam and air. The SPACENET® layers are examples of such "indented fiber layers." As used herein, the term spacing structure for convenience is defined to include at least suitable types of "indented fiber layers" and suitable types of "three dimensional engineered materials."

In the fabrication of a seat cushion, it has been found that improved pressure distribution is provided when the seat cushion is designed to form fit the buttocks of the person sitting on the cushion. When such seat cushions are used by patients who have experienced skin tissue breakdown on their buttocks, the improved pressure distribution will permit the patients to sit up in chairs for greater periods of time for the therapeutic value that accomplishes.

An apparatus of the present invention is therefore configured to support at least a portion of a body thereon. The apparatus includes a cover having an interior region, a base located within the interior region, and a three dimensional engineered material located within the interior region above the base. The three dimensional engineered material and the base cooperate to provide support for the body.

In one embodiment, an apparatus configured to support at least a portion of a body thereon is provided comprising a base portion including a plurality of zones, each zone having associated support characteristics, the base portion configured to provide a static support for the body; a pressure distribution layer supported by at least a first zone of the base portion, the pressure distribution layer including a spacing structure configured to provide air passage therethrough and to distribute pressure from the body over a greater area of the first zone; and a cover positioned between the pressure distribution layer and the portion of the body to be supported, the cover being coupled to a first source of air to provide air circulation through the pressure distribution layer. In one example, the base portion includes a plurality of inflatable bladders, each of the plurality of zones including at least one of the plurality of bladders. In one variation, the apparatus further comprises a controller configured to control the pressure in each support zone of the plurality of support zones of the base portion, the controller configured to generally pressurize the first support zone at a first pressure and to generally pressurize a second support zone at a second pressure, the second pressure differing from the first pressure when the base portion is configured to provide a static support.

In a further embodiment, an apparatus configured to support at least a portion of a body thereon is provided comprising an inflatable first layer including a plurality of support zones, a second layer positioned between the first layer and the portion of the body to be supported, the second layer including a spacing structure, and a controller configured to control the pressure in each support zone of the plurality of support zones of the inflatable first layer. In one example, the inflatable first layer is configured to provide a static support surface wherein a first support zone is configured to be generally pressurized at a first pressure and a second support zone is configured to be generally pressurized at a second pressure, the second pressure differing from the first pressure. In another example, the inflatable first layer is configured to provide at least one therapy to the portion of the body supported thereon. In yet another example, the apparatus further comprises a cover configured to confine at least the second layer of the first layer and the second layer and including a first portion positioned adjacent the portion of the body to be supported, the first portion including a moisture vapor permeable material. In one variation, the cover is coupled to a source of air to provide air circulation through the second layer and the through the moisture vapor permeable material of the first portion of the cover.

In another embodiment, an apparatus configured to support at least a portion of a body thereon is provided comprising an inflatable first layer including a plurality of support zones, the plurality of support zones including a first support zone which generally corresponds to the chest region of the body, a second layer positioned between the first layer and the portion of the body to be supported, the second layer comprising a spacing structure, a controller configured to control the pressure of each support zone of the first inflatable layer and further to control the pressure of the first support zone to provide a percussion therapy to the chest region of the body, and a cover positioned between the second layer and the portion of the body to be supported. In one example, the cover defines an interior region, the second layer being positioned within the interior region. In one variation, the apparatus further comprises a source of air coupled to the cover such that air is forced through the second layer. In another example, the cover defines an interior region, the second layer being positioned within the interior region, and at least a portion of a top surface of the cover is made from a breathable material, the portion of the top surface and the second layer cooperating to provide cooling for the body supported on the portion of the top surface. In one variation, the apparatus further comprises a source of air coupled to the cover to provide air circulation through the second layer.

Additional features and advantages of the invention will become apparent to those skilled in the art upon consideration of the following detailed description of the illustrated embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
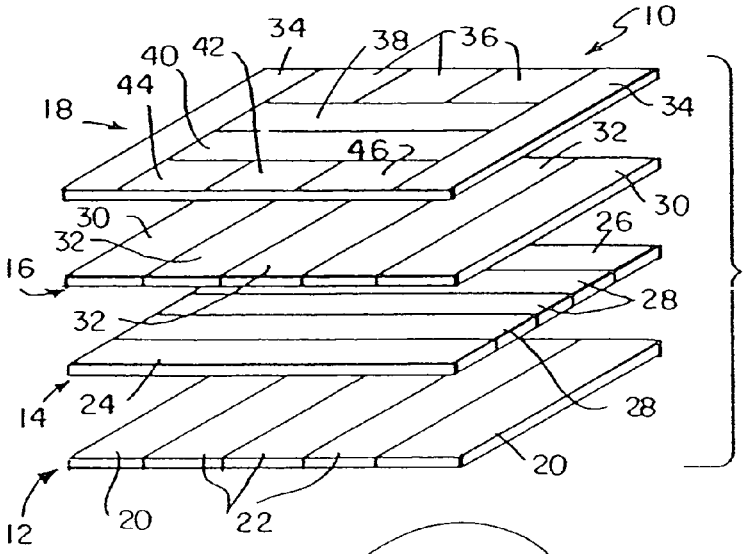
FIG. 1 is an exploded perspective view of a support surface base according to one embodiment of the present invention.

While the invention is susceptible to various modifications and alternative forms, exemplary embodiments thereof have been shown by way of example in the drawings and will herein be described in detail. It should be understood, however, that there is no intent to limit the invention to the particular forms disclosed.

One embodiment of the present invention includes a base 10 upon which the three dimensional engineered material or the indented fiber layers are placed. The base 10 includes a plurality of layers of foam with each layer comprising a plurality of sections or strips of foam such as shown in FIG. 1. The FIG. 1 embodiment comprises four separate layers 12, 14, 16, 18 with each layer comprising a plurality of strips as illustrated. The strips are illustratively bonded together at their edges using conventional bonding techniques. The strips have various ILD ratings to provide desired support characteristics.

Lower layer 12, for instance, has its two outside strips 20 which are illustratively made from 150 ILD rating foam while the three central strips 22 are made from 60 ILD rating foam. The base 10 of FIG. 1 is a lattice structure in which the strips comprising the lower layer 12 are extending from front-to-back while the strips comprising the second layer 14 are extending transversely or side-to-side. The layer 14 comprises five transversely extending strips, the front and back strips 24, 26 being, for example, of 90 ILD rating foam. The three central strips 28 comprising the second layer 12 may be made from a foam having a softer or more deformable ILD rating. The third layer 16 is constructed such that each of its side strips 30 are made from 60 ILD rating foam while its three central strips 32 are made from 30 ILD rating foam as illustrated in FIG. 1.

The uppermost layer 18 has a pair of side strips 34 (extending front-to-back) made from 60 ILD foam. The upper layer 18 also has three transversely extending small pieces 36 at the back of the cushion with ILD ratings of 150, three centrally located sections 38, 40, 42 having a 30 ILD rating, and two side small sections 44, 46 have a 60 ILD rating. It will be appreciated that when these layers 12, 14, 16, 18 are superimposed together, the side edges (front-to-back) are provided largely by foam strips with higher ILD ratings including the first layer 12 side strips 20 with 150 ILD ratings and the third layer 16 with side strips 30 of 60 ILD ratings and the upper layer 18 with its side strips 34 with 60 ILD ratings. In the center of the composite cushion, in all four layers, the foam base 10 has lower ILD rating foam. At the back of the cushion, foam strips with higher ILD ratings including the 90 ILD rating strip 26 in the second layer 14 and the 150 ILD rating strips 36 in the upper layer 18 provide significant rigidity at the back.

With the composite structure shown in FIG. 1, the foam base conforms to the buttocks of the person sitting on the cushion. Alternatively, in accordance with the present invention, a cushion base 50 is formed by sculpting a single piece of foam 52 or a piece of foam made from various composite components bonded together to have the contour recessed portions 54 shown in FIG. 2 configured to match a person's anatomy.

Figure 2:
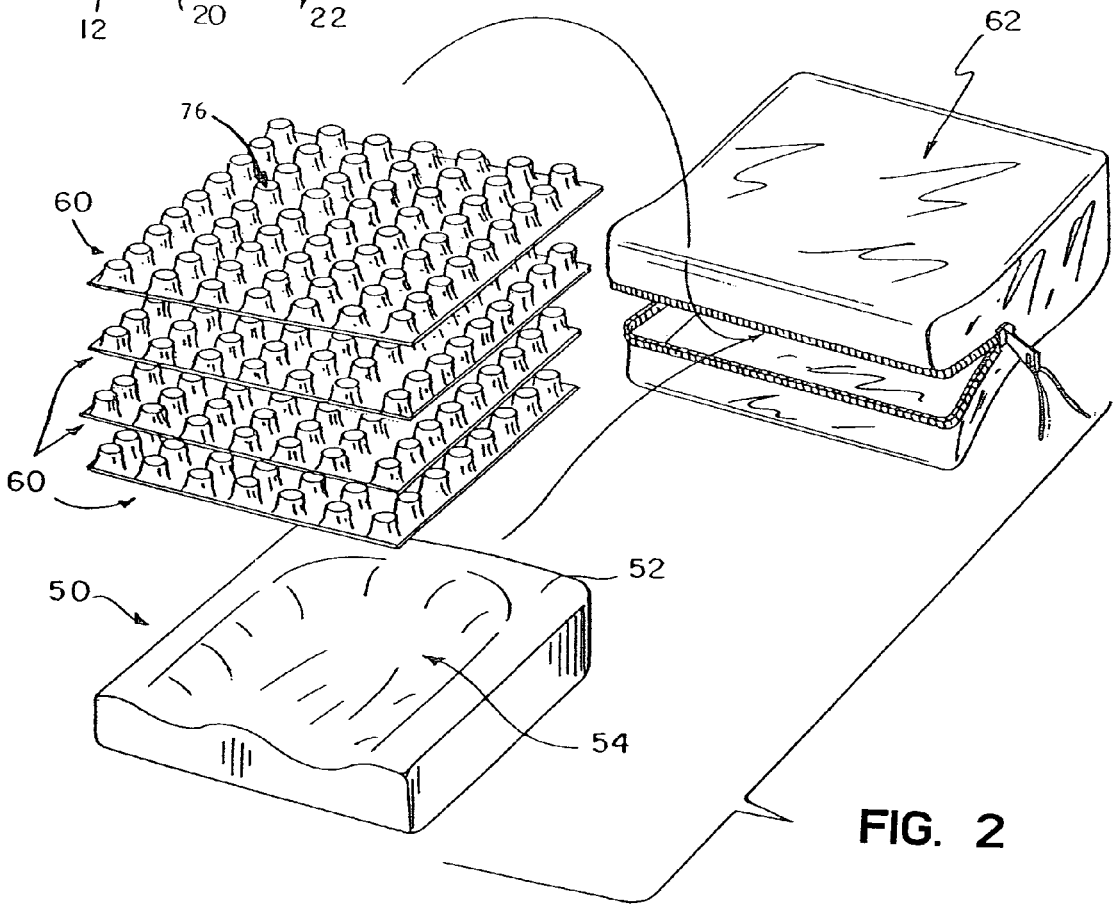
FIG. 2 is an exploded perspective view of another support surface of the present invention including a base, and a plurality of layers of three dimensional engineered material, and an outer cover.
Figure 2A:
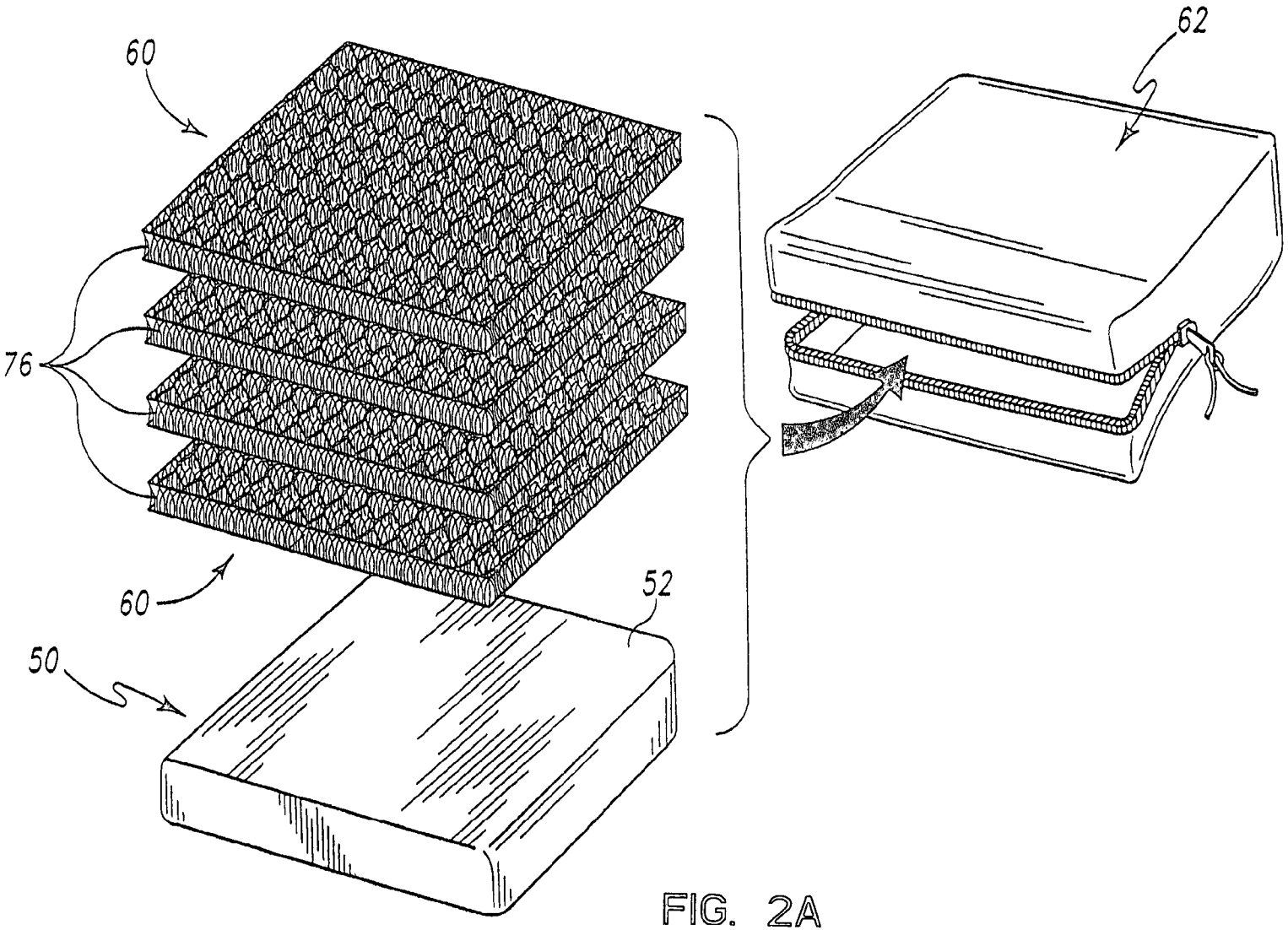
FIG. 2A is an exploded perspective view of yet another support surface of the present invention including a base, and a plurality of layers of three dimensional engineered material, and an outer cover.

The present invention includes placing above such a foam base 10, 50, one or more indented fiber layers or other such three dimensional engineered material layers over the base 10, 50. Typically, two to four such layers 60 are provided as illustrated in FIG. 2 and FIG. 2A. The foam base 10, 50 and the plurality of layers 60 are then encased in a cover 62 as shown in FIG. 2 and FIG. 2A. Details of the three dimensional engineered material layers are discussed above.

Figure 3:
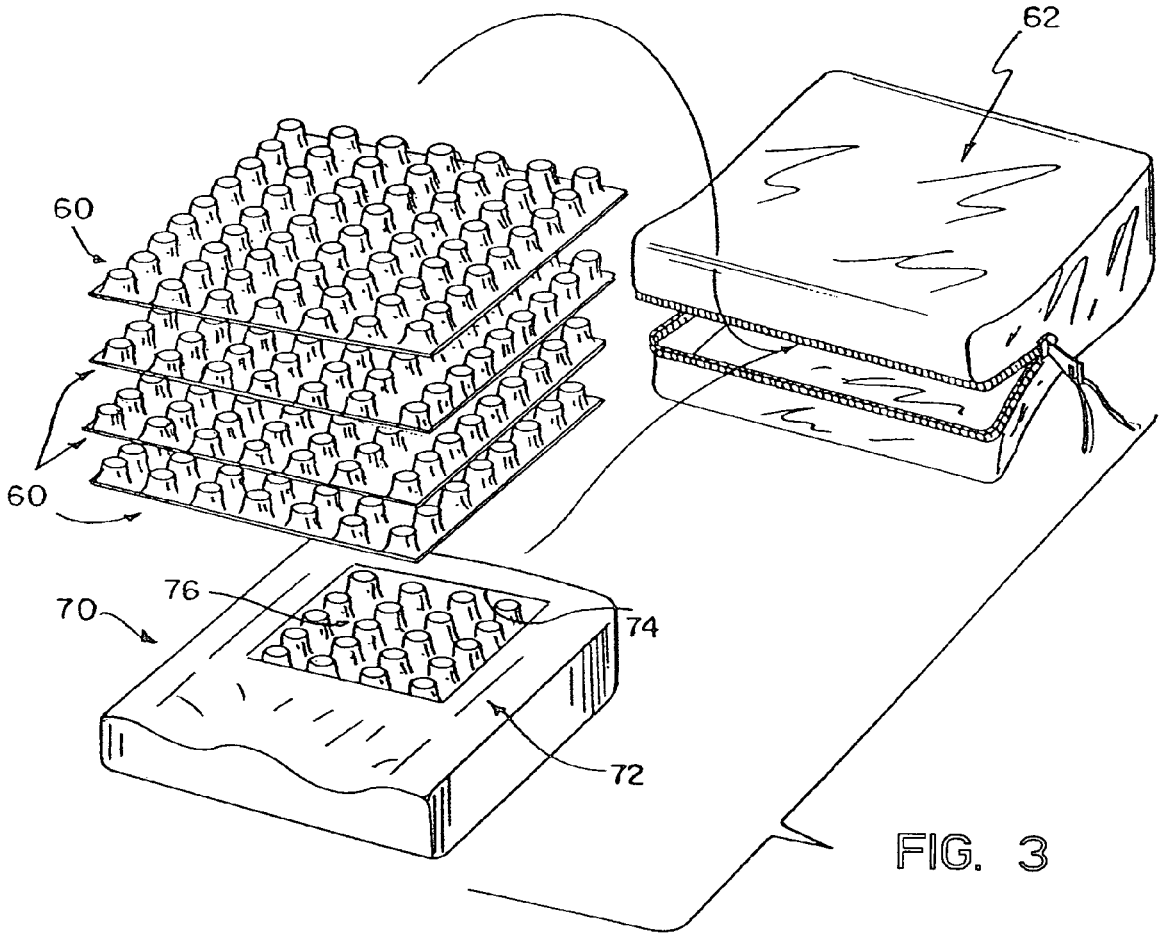
FIG. 3 is an exploded perspective view of another embodiment of the present invention similar to FIG. 2 in which the contoured base is also formed to include a recessed portion configured to receive at least one layer of three dimensional engineered material therein.
Figure 4:
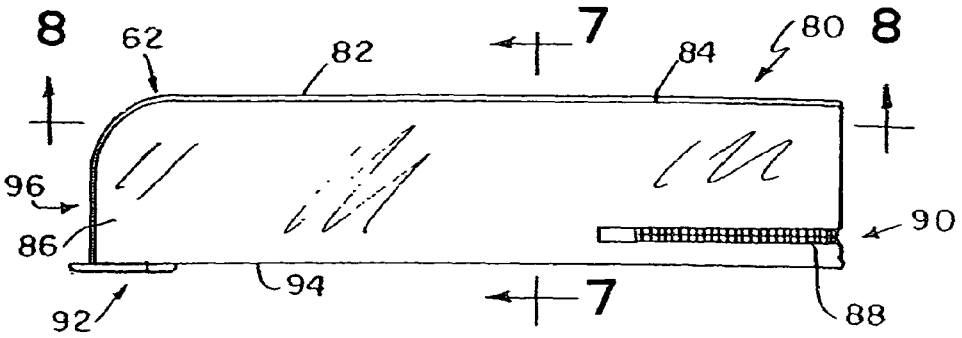
FIG. 4 is a side elevational view of another cushion structure of the present invention.
Figure 5:
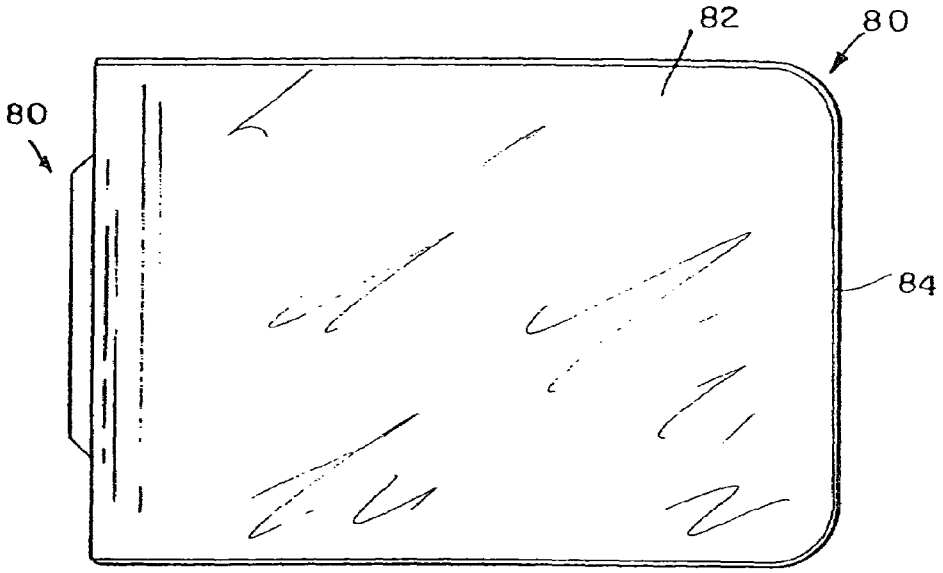
FIG. 5 is a top view of the cushion structure of FIG. 4.

In FIG. 3, a sculptured molded foam base 70 includes a contoured center portion 72 and is a cutout or recessed section 74 which is filled with at least one layer of three dimensional engineered material 76. A plurality of layers 60 similar to FIG. 2 are then placed over base 70. Base 70 and layers 60 are then located inside cover 62.

Figure 6:
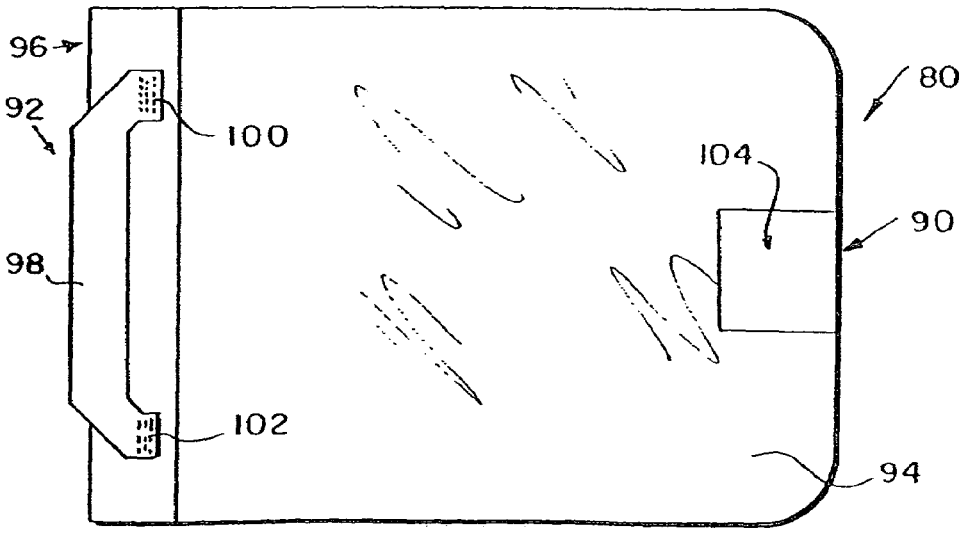
FIG. 6 is a bottom view of the cushion structure of FIGS. 4 and 5.

Another embodiment of the present invention is illustrated in FIGS. 4–11. FIGS. 4–8 illustrate a cushion 80 having a top surface 82 and surrounding piping 84. Side walls 86 are illustratively made from heavy material which permits air to pass through. A zipper 88 is provided adjacent a rear portion 90 of the cushion 80 to provide access to an interior region. A handle 92 is coupled to a bottom surface 94 adjacent a front portion 96 of the cushion 80. FIG. 6 illustrates additional details of the handle 92. Handle 92 includes a central gripping portion 98 and ends 100 and 102 which are coupled to the bottom surface 94 by suitable means such as sewing, RF welding, or other suitable attachment. A label 104 is also located on the bottom surface 94.

Figure 7:
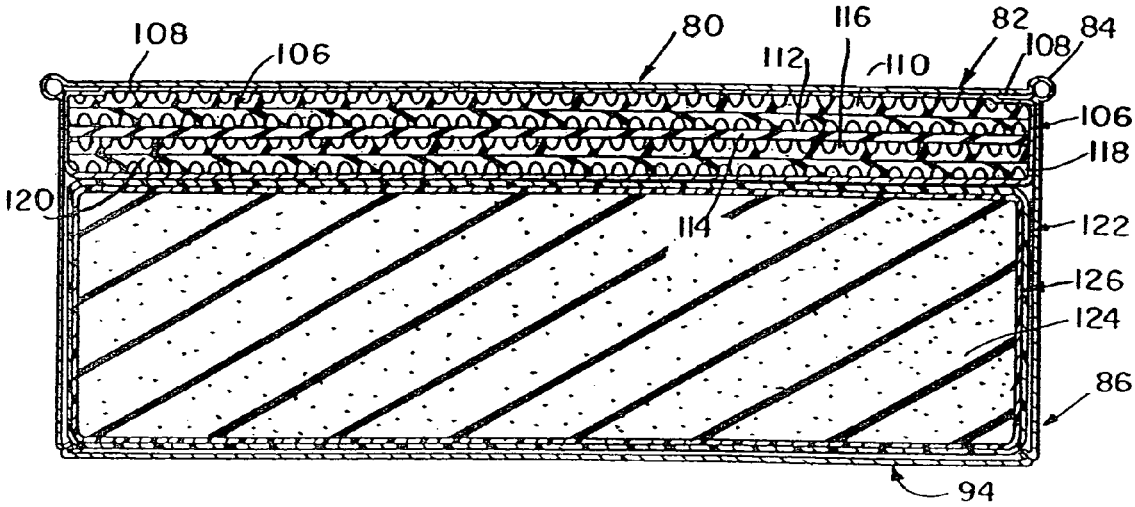
FIG. 7 is a sectional view taken along lines 7—7 of FIG. 4.
Figure 8:
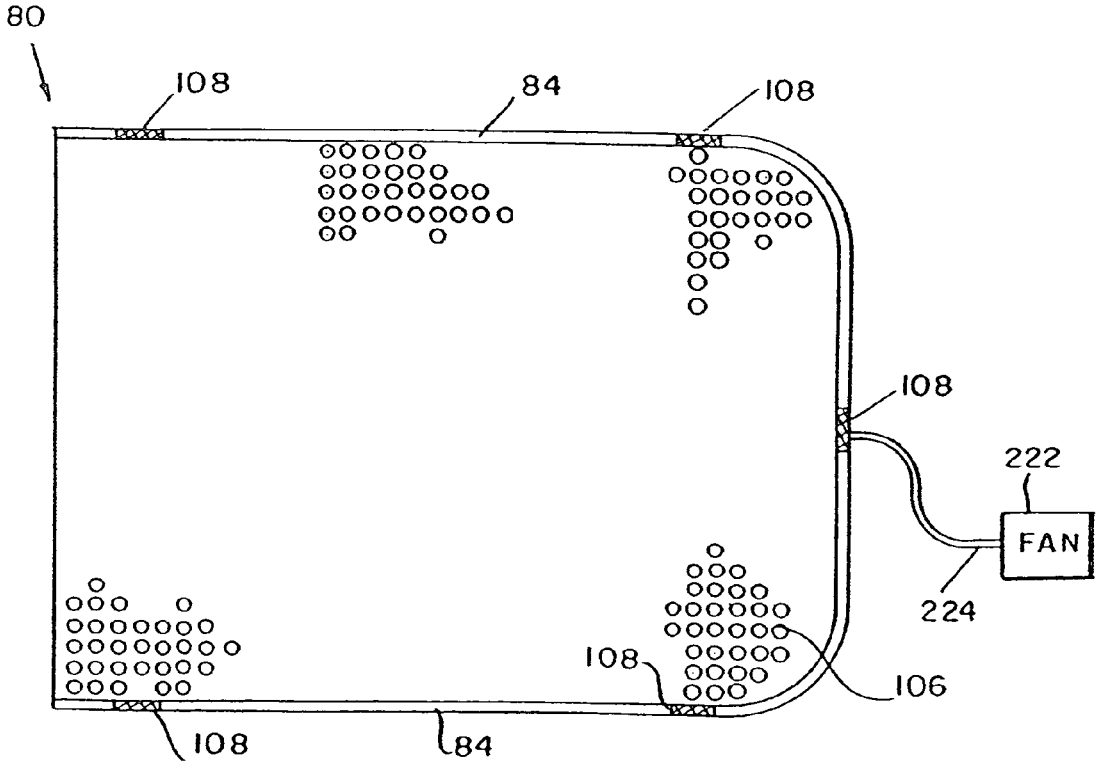
FIG. 8 is a sectional view taken along lines 8—8 of FIG. 4.

Further details of the cushion 80 are shown in FIGS. 7 and 8. Illustratively, the cushion includes a plurality of layers of three dimensional engineered material 106 located adjacent top surface 82. Top surface 82 is illustratively made from a breathable material such as Lycra. The three dimensional engineered material 106 is illustratively coupled to the outer piping 84 by suitable attachment such as stitching, welding, gluing, etc. at a plurality of locations as indicated by reference number 108 in FIGS. 7 and 8. Therefore, the engineered material layers 106 are permitted to float or move relative to the top surface 82 of the cushion 80. Illustrative examples of the different types of three dimensional engineered material 106 are discussed above.

In the illustrated embodiment, four layers of Spacenet material are used including a top layer 110 with the indentions pointing upwardly, a second layer 112 with the indentions pointing downwardly, a central spacer layer 114 below layer 112, a layer 116 with the indentions pointing upwardly, and a layer 118 with the indentions pointing downwardly. Therefore, the layer of the three dimensional engineered material 106 is provided within the cover 62 of the cushion 80.

Cushion 80 further includes an inner plastic cover 122 surrounding a foam base 124. As discussed above, the foam base 124 can be a single piece of foam, a plurality of foam sections having different densities and ILDs stacked lengthwise or widthwise, or a plurality of layers of foam having different densities and ILDs.

A fire sock 126 is located between the plastic cover 122 and the foam base 124. Bottom surface 94 is illustratively made from an anti-skid material such as a dipped open weave nylon material.

Figure 9:
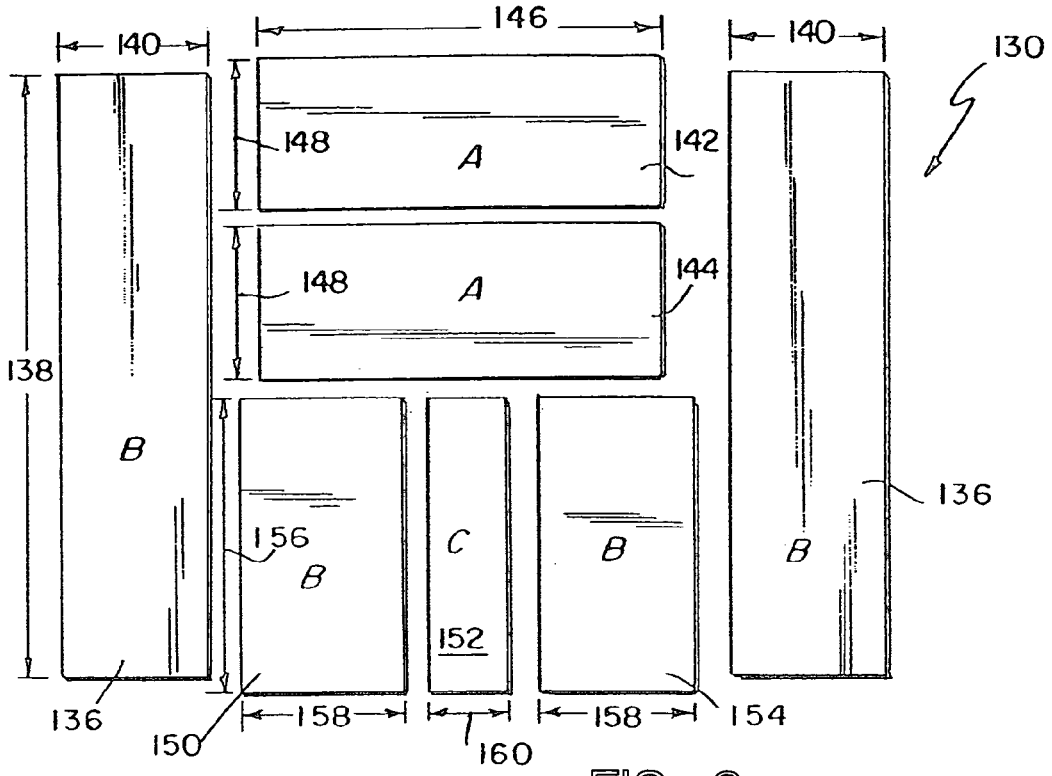
FIG. 9 is a view illustrating components of a top foam layer of a foam base configured to be inserted into an interior region of a cover shown in FIGS. 4–8.
Figure 10:
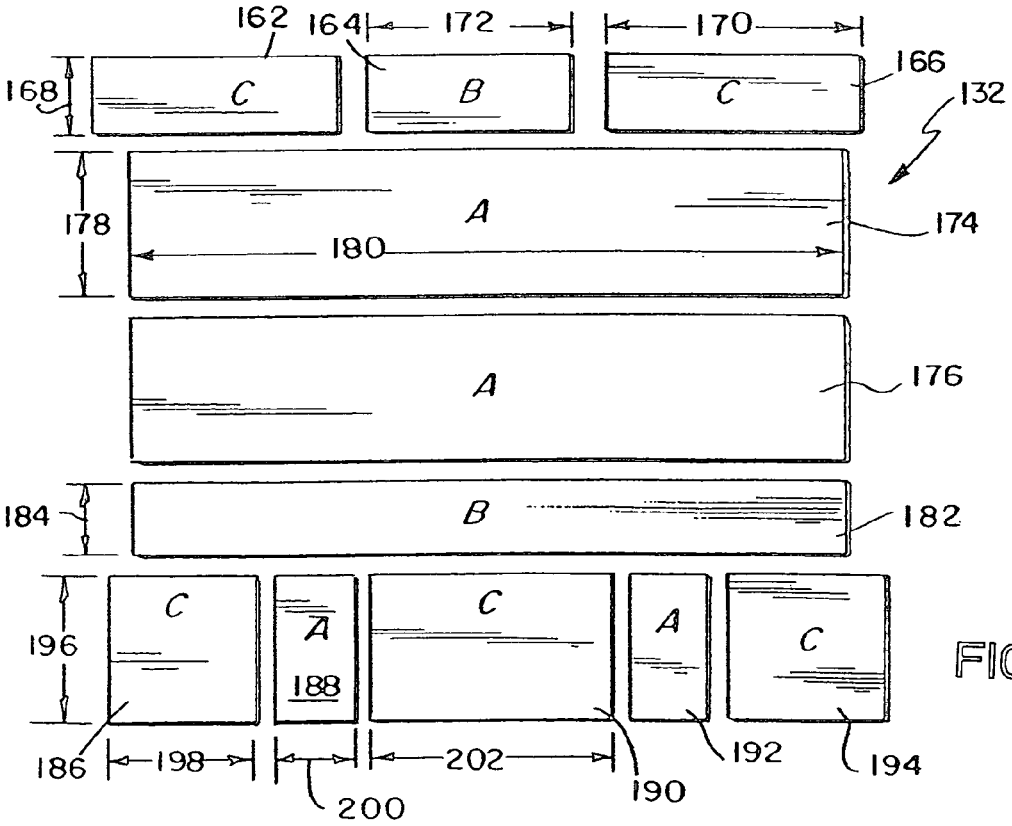
FIG. 10 is a view illustrating components of a middle foam layer of the base.
Figure 11:
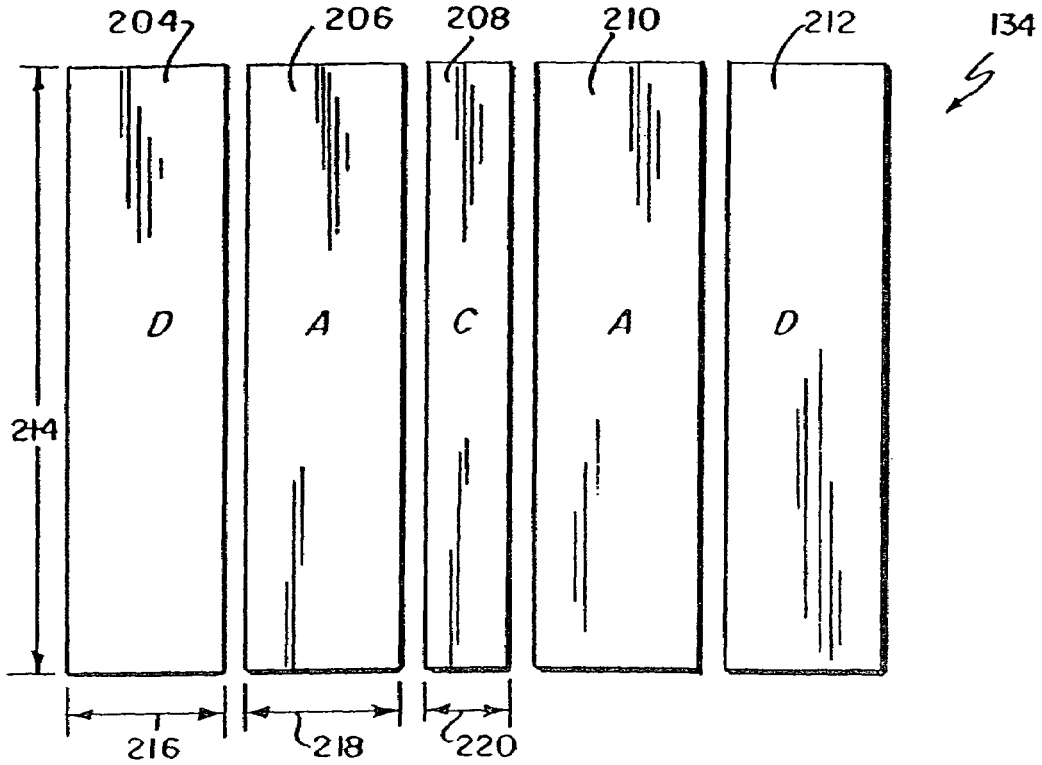
FIG. 11 is a view illustrating components a bottom foam layer of the base.

Another embodiment of the foam base is illustrated in FIGS. 9–11. A top layer 130 of foam base 124 is illustrated in FIG. 9. A middle layer 132 of foam base 124 is illustrated in FIG. 10, and a bottom layer 134 of foam base 124 is illustrated in FIG. 11. It is understood that all the separate foam sections are glued together to form a substantially continuous layer of material for each of the three layers 130, 132, 134. Top layer 130 is glued to middle layer 132, and middle layer 132 is glued to the bottom layer 134.

Each of the foam sections is labeled with designations A, B, C, or D. These designations indicate the ranges of densities, and ILDs of the various foam sections to be discussed. The specifications for the foam sections are illustratively as follows:

| Foam Section | Density | ILD | Type |
|---|---|---|---|
| A | 1.7–1.8 | 40–47 | 1745 |
| B | 3.0 | 61–71 | Q61 |
| C | 1.7–1.8 | 90–100 | LH96X |
| D | 4.0–4.25 | 171–181 | Z171 |

Top foam layer 130 includes outer sections 136 illustratively having a length dimension 138 of 16 inches and width dimension 140 of 4 inches. Two sections 142 and 144 are located adjacent a back portion of top layer 130. In other words, section 142 is located adjacent back portion 90 within the cushion 80. Sections 142 and 144 each have a width dimension 146 of 10 inches and a length dimension 148 of 4 inches. Top layer 130 further includes front sections 150, 152 and 154. Sections 150 and 154 each have length dimensions 156 of 8 inches and width dimensions 158 of 4 inches. Central section 152 has a length dimension of 8 inches and a width dimension 160 of 2 inches. It is understood that dimensions used in FIGS. 9–10 are for illustrative purposes only. Sections having different widths and lengths may be used depending upon the size of the cushion and firmness characteristics desired.

Middle layer 132 is illustrated in FIG. 10. Middle layer 132 includes three back sections 162, 164, and 166. Outer back sections 162 and 166 each have a length dimension 168 of 2 inches and a width dimension 170 of 6.5 inches. Center back section 164 has a length of 2 inches and a width dimension 172 of 5 inches. Middle layer 132 further includes two low density, low ILD layers 174 and 176. Layers 174 and 176 each have a length dimension 178 of 4 inches and a width dimension 180 of 18 inches. A slightly higher ILD section 182 is located adjacent section 176. Section 182 has a width dimension of 18 inches and a length dimension 184 of 2 inches. Middle layer 132 further includes a plurality of front foam sections 186, 188, 190, 192, and 194. Outer sections 196 and 194 have a length dimension 196 of 4 inches and a width dimension 198 of 4 inches. Sections 188 and 192 each have a width dimension 200 of 2 inches and length dimension of 4 inches. Center section 190 has a length dimension of 4 inches and a width dimension 202 of 6 inches.

Bottom layer 134 is illustrated in FIG. 11. Illustratively, bottom layer 134 includes five sections 204, 206, 208, 210, and 212 extending front to back. Outer sections 204 and 212 have a high density and high ILD. Outer sections 204 and 212 each have a length dimension 214 of 16 inches and width dimension 216 of 4 inches. Sections 206 and 210 are located inwardly of outer sections 204 and 212, respectively. Sections 206 and 210 each have a low density and low ILD. Sections 206 and 210 have a length dimension of 16 inches and a width dimension 218 of 4 inches. Center portion 208 has a relatively high ILD. Central section 208 has a length dimension of 16 inches and a width dimension 220 of 2 inches. After the top layer 130, the middle layer 132, and the bottom layer 134 are all coupled together to form a base 124, the base 124 is inserted into the cover 62 as illustrated above to form an improved seating cushion 80.

In another embodiment of the present invention, a fan 222 is coupled to the cushion 80. Illustratively, fan 222 is coupled to the cushion 80 by a tube 224 as shown in FIG. 8. Fan 222 may be packaged to sit on the floor or may include a bracket for coupling the fan 222 to a wheelchair, chair, bed, etc. The fan 222 forces air through the three dimensional engineered material 106 and top surface 82 to provide cooling for a person situated on the cushion 80.

Figure 12:
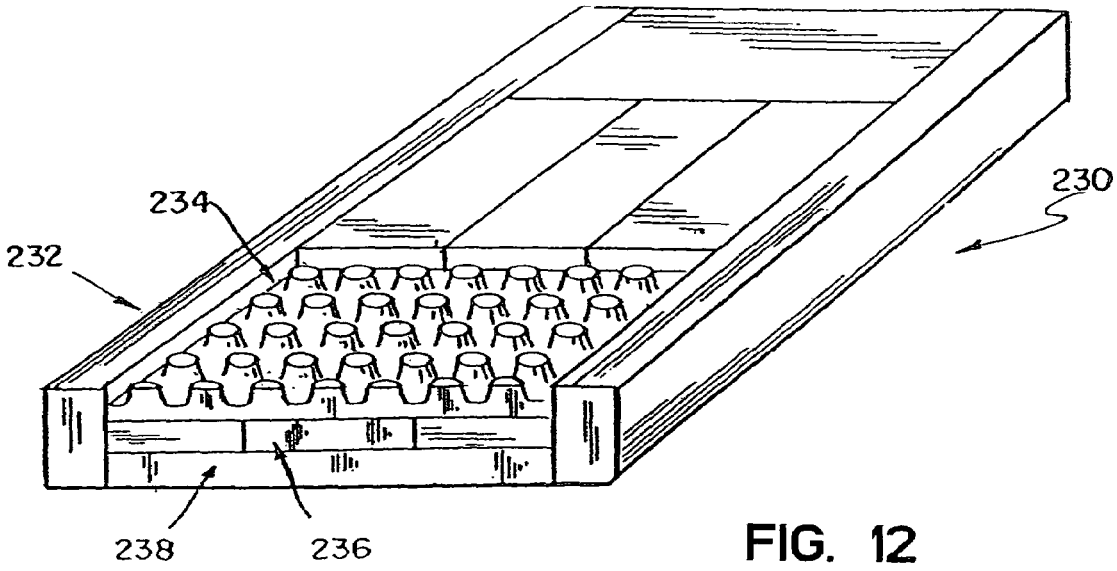
FIG. 12 is a perspective view a mattress in accordance with the present invention.

As illustrated in FIG. 12, the apparatus of the present invention may also be used in a mattress or other support surface 230. The zones of the mattress 230 are illustratively made from foam sections having different densities and ILD ratings. In addition, the mattress 230 includes a foot end 232 having three dimensional engineered material 234 located therein above foam layers 236 and 238. The fan 222 may also be coupled to the support structure illustrated in FIG. 12 to provide air flow and cooling through zone 232.

In one embodiment, the support described above including the spacing structure is provided as a overlay to a second support comprising a plurality of air bladders configured to provide at least one type of therapy including alternating pressure therapy, percussion and vibratory therapy, or rotational therapy. Exemplary aspects of alternating pressure therapy, percussion or vibration therapy, rotational therapy, and the configurations of a support to perform the same are shown in U.S. Pat. No. 4,949,414 issued Aug. 21, 1990 to Thomas et al. titled "Modular Low Air Loss Patient Support System and Methods for Automatic Patient Turning and Pressure Point Relief," the disclosure of which is herein expressly incorporated by reference and U.S. Pat. No. 6,415,814 issued on Jul. 9, 2002 to Barry D. Hand et al. and titled "Vibratory Patient Support System," the disclosure of which is herein expressly incorporated by reference. In one example, the overlay support including the spacing structure is generally a sealed overlay. In a further example, the overlay support includes a cover made from a breathable material. In another example, the overlay support including the spacing structure is configured to provide a low air loss therapy.

Figure 13:
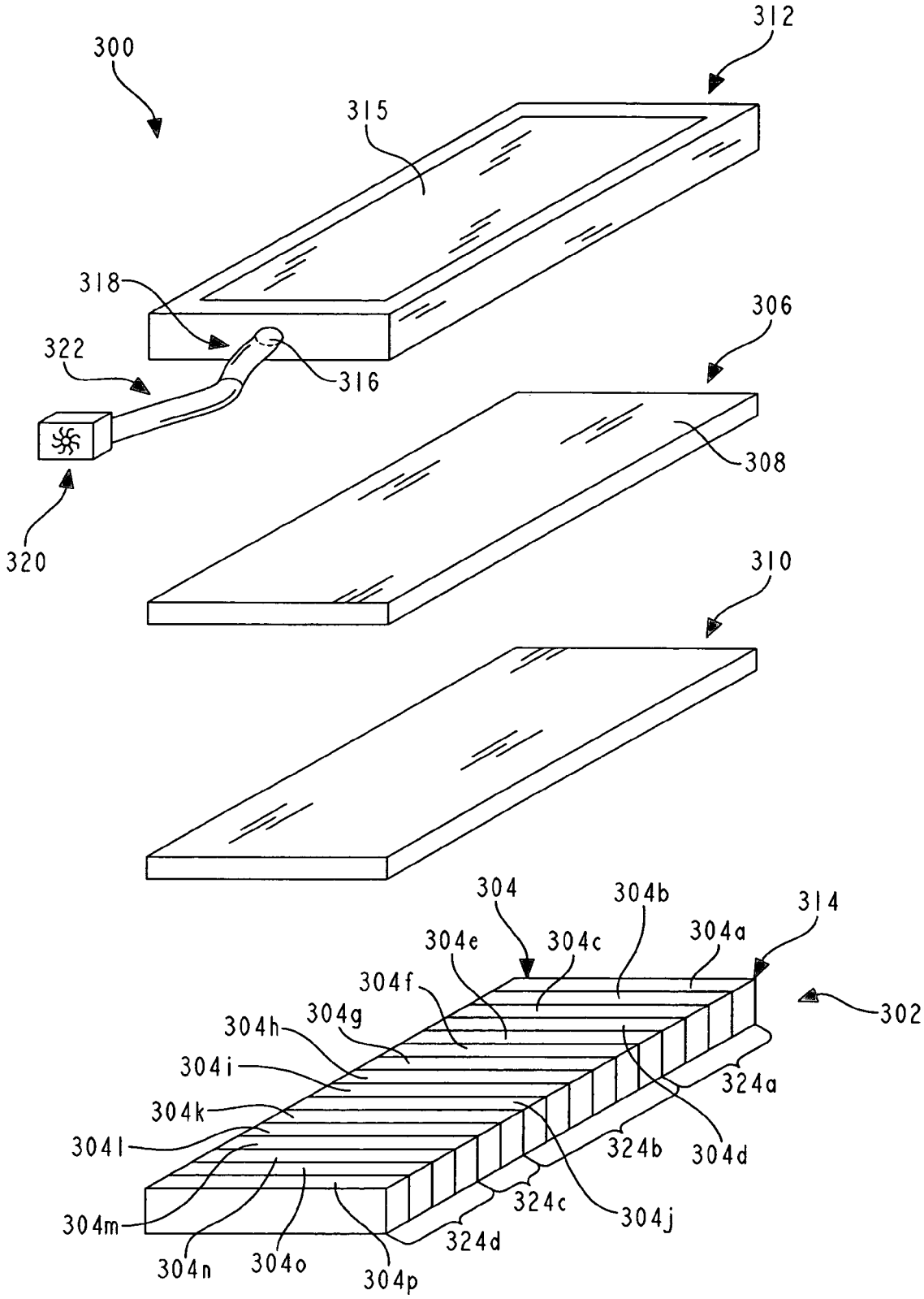
FIG. 13 is a perspective view of a support comprising a first layer having a plurality of air bladders and a second layer including a spacing structure.

As illustrated in FIG. 13, the apparatus of the present invention is also used in a support or cushion 300. Support 300 includes a first layer 302 configured to provide at least one type of therapy including alternating pressure therapy, percussion and vibratory therapy, or rotational therapy including a plurality of air bladders 304*a*–*p* and a second layer 306 including a spacing structure 308. Spacing structure 308 in one embodiment comprises one or more indented fiber layers or other such three dimensional engineered material layers having a plurality of resilient members. In one example the SPACENET® material is used as spacing structure 308.

In one example, first layer 302 provides a generally constant pressure profile across air bladder 304*a*–*p*. In a further example, first layer 302 is configured such that combinations of adjacent air bladders 304*a*–*p* define body support zones which support different portions of the patient at different pressures. In another example, first layer 302 is configured to provide an alternating pressure therapy wherein every other or every third or other multiple of air bladders 304*a*–*p* are plumbed together to define bladder sets such that a patient may be supported by first layer 302 while simultaneously relieving pressure points by cyclically dropping and/or elevating the pressure in the respective bladder sets. In one variation, all of air bladders 304*a*–*p* provide an alternating pressure therapy. In another variation, at least two of the air bladders 304*a*–*p* provide an alternating pressure therapy. In yet a further example at least one of the air bladders 304*a*–*p* is configured to provide a percussion therapy wherein the pressure of the at least one air bladder 304*a*–*p* is dropped and elevated at a rate sufficient to and amount to impart a vibration to the patient. In one variation, the vibration is directed at a chest region of the patient to aid in the breakdown of undesired materials in the lungs of the patient. In still a further example at least one of air bladders 304*a–p* is configured to provide a rotational therapy to the patient. Exemplary aspects of alternating pressure therapy, percussion or vibration therapy, rotational therapy, and the configurations of a support to perform the same are shown in U.S. Pat. No. 4,949,414 issued Aug. 21, 1990 to Thomas et al. titled "Modular Low Air Loss Patient Support System and Methods for Automatic Patient Turning and Pressure Point Relief," the disclosure of which is herein expressly incorporated by reference and U.S. Pat. No. 6,415,814 issued on Jul. 9, 2002 to Barry D. Hand et al. and titled "Vibratory Patient Support System,"," the disclosure of which is herein expressly incorporated by reference In the illustrated embodiment, an impermeable sheet 310 is positioned between spacing structure 308 and the plurality of air bladders 304*a–p* and is configured to keep fluids and moisture away from bladders 304*a–p*. A cover 312 overlays spacing structure 308 and is secured to impermeable sheet 310 with a suitable fastener 311. Example suitable fasteners include snaps, hook and loop fasteners, or zippers. As such, cover 312 and impermeable sheet 310 cooperate to enclose spacing structure 308 within an interior region between cover 312 and impermeable sheet 310. The combination of spacing structure 308, impermeable sheet 310, and cover 312 is portable and can be placed upon any suitable support layer, such as first layer 302 including plurality of bladders 304*a–p*. It is further contemplated that cover 312, and/or impermeable sheet 310 is configured to be secured to first layer 302 with a suitable fastener.

Alternatively, the cover and the impermeable sheet are made as a single unit or bag with an opening wherein the spacing structure is placed in an interior region thereof. The opening is closed with any suitable fasteners, such as snaps, hook and loop fasteners, or zippers. The single unit or bag may then be placed upon and/or coupled to any suitable support layer, such as first layer 302 including plurality of bladders 304*a–p*.

As a further alternative, a top portion 314 of first layer 302, such as the top portions of air bladders 304*a–p* are made from an impermeable material and combine to form an impermeable sheet. As such, spacing structure 308 is placed in the interior region formed by cover 312 and the impermeable sheet created by the top portion of the first layer. Cover 312 is secured to first layer 302 with any suitable fasteners, such as snaps, hook and loop fasteners, or zippers.

As yet a further alternative, the cover is a single unit or bag with an opening wherein spacing structure 308 and first layer 302 including the impermeable sheet formed from the top portion of first layer 302 are placed in an interior thereof. As such, the cover encloses both the first layer and the second layer.

As still a further alternative, the cover is a single unit with an opening wherein spacing structure 308 is placed. The cover and spacing structure 308 are then positionable and/or securable to first layer 302. As such, the cover is interposed between the impermeable sheet of first layer 302 and spacing structure 308.

Referring back to the illustrative embodiment shown in FIG. 13, a top portion 315 of cover 312 is made from a moisture vapor permeable material which allows air and moisture to pass there through. Illustratively, a coupler 318 is attached to cover 312 and is configured to be coupled to a source of air, such as fan 320, through a tube 322. As such, air supplied by fan 320 passes through tube 322 and enters the interior region between cover 312 and impermeable sheet 310 through opening 316 in cover 312. The air entering opening 316 is forced through spacing structure 308 and exits top portion 315 of cover 312 to provide cooling for a person being supported by support 300. In one example, fan 320 includes a heating element such that the air provided to the interior region may be heated above the ambient temperature. In one variation controller 334 controls the heating element and thus the temperature of the air.

In an alternate embodiment, cover 312 includes a plurality of apertures in the top portion to provide low air loss therapy. In another example, top portion 315 of cover 312 is formed to contain a heating element such as Gorix™ material. Controller 334 is electrically coupled to the heating element. The heating element is used to warm the patient on support 300. An example support incorporating a heating material is disclosed in copending U.S. patent application Ser. No. 09/701,499, filed on Nov. 29, 2000 by Hand et al. and titled "Heated Patient Support Apparatus," the disclosure of which is herein expressly incorporated by reference.

In another alternate embodiment first layer 302 is combined with a low air loss layer comprising a plurality of air chambers such as the mattress assembly shown in at least one of U.S. Pat. No. 5,794,288 issued on Aug. 18, 1998 to Soltani et al. titled "Pressure Control Assembly for an Air Mattress," U.S. Pat. No. 6,240,584 issued on Jun. 5, 2001 to Perez et al titled "Mattress Assembly," and the SilkAir® Therapy System both sold by Hill-Rom located in Batesville, Ind. and at 4349 Corporate Road, Charleston, S.C. 29405.

In one embodiment, wherein support 300 does not provide low air loss therapy, cover 312 of support 300 still overlays spacing structure 308 as described above, however cover 312 does not include a portion made from a moisture vapor permeable material. Support 300 does further include a pad (not shown) including a wicking material that is positionable upon cover 312 and securable to cover 312 or other portions of support 300. The wicking material is configured to pull moisture away from the patient positioned on the pad such that the skin of the patient can be kept generally dry.

Figure 14:
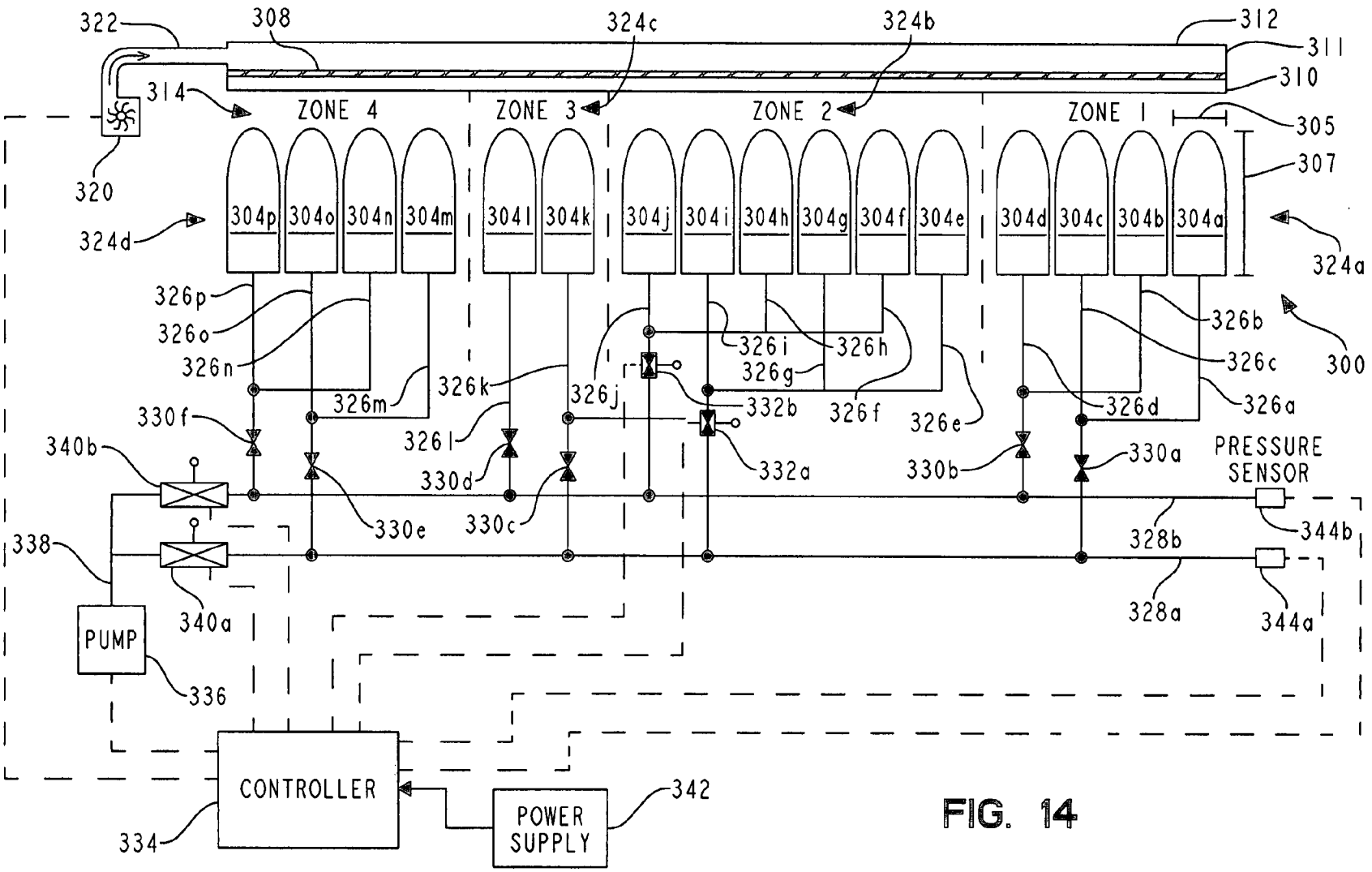
FIG. 14 is a diagrammatic side vide of the support FIG. 13 coupled to an air pressure control system.

Referring to FIG. 14, in one embodiment, a width of individual air bladders 304*a–p* of first layer 302, illustratively such as a width 305 of air bladder 304*a* is preferably between about 1 inch to about 2.5 inches, between about 1 inch to about 2 inches, or between about 1.5 inches to about 2.5 inches and a height of individual air bladders 304*a–p*, illustratively, such as a height 307 of air bladder 304*a* is about 6 inches to about 8 inches. The preferred width 305 of air bladder 304*a* reduces the amount of shear experienced by a patient lying on support 300 when at least a portion of support 300 is configured to provide alternating pressure as compared to larger bladder widths, such as about 6 inches to about 8 inches.

In one embodiment, first layer 302 is divided into a plurality of support zones 324*a–d*. Support zone 324*a* generally corresponds to the leg and foot region of the patient supported on support 300. Support zone 324*b* generally corresponds to the seat and thigh region of the patient supported on support 300. Support zone 324*c* generally corresponds to the chest region of the patient supported on support 300. Support zone 324*d* generally corresponds to the head region of the patient supported on support 300. Although, four support zones are shown, it is within the scope of the present invention to have various configurations comprising one or more support zones.

Each support zone 324*a–d* contains at least one bladder 304 and preferably includes a plurality of bladders. As shown in FIGS. 13 and 14, support zone 324*a* includes bladders 304*a–d*, support zone 324*b* includes bladders

304*e–j*, support zone 324*c* includes bladders 304*k* and 304*l*, and support zone 324*d* includes bladders 304*m–p*. Further, it is within the scope of the present invention to vary either the overall number of air bladders or the number of air bladders in at least one support zone or both.

Air is supplied to each bladder 304*a–p* through bladder supply lines 326*a–p* coupled to respective bladders 304*a–p* as illustratively shown in FIG. 14. Bladder supply lines 326*a–p* are supplied by one of two main supply lines 328*a* and 328*b*. In an alternative embodiment a single main supply line is coupled to all of the bladder supply lines. In a further alternate embodiment, three or more supply lines are coupled to various groupings of air bladders.

Illustratively, each bladder supply line 326*a–p* is coupled to either main supply line 328*a* or main supply line 328*b* through a fixed valve 330 or a three-way valve 332. As shown in FIG. 14, bladders 304*a* and 304*c* are coupled to line 328*a* through fixed valve 330*a*, bladders 304*b* and 304*d* are coupled to line 328*b* through fixed valve 330*b*, bladders 304*e*, 304*g*, and 304*i* are coupled to line 328*a* through three-way valve 332*a*, bladders 304*f*, 304*h*, and 304*j* are coupled to line 328*b* through three-way valve 332*b*, bladder 304*k* is coupled to line 328*a* through fixed valve 330*c*, bladder 304*l* is coupled to line 328*b* through fixed valve 330*d*, bladders 304*m* and 304*o* are coupled to line 328*a* through fixed valve 330*e*, bladders 304*n* and 304*p* are coupled to line 328*b* through fixed valve 330*f*. The configuration shown in FIG. 14 is for illustrative purposes and it is within the scope of the present invention to use only three-way valves, only fixed valves, or other configurations of three-way valves and fixed valves to couple the air bladders to the supply lines. Further it is within the scope of the present invention to use variable valves such as electronic control valves.

Fixed valves 330*a–f* are configured to control the rate of flow into and out of corresponding air bladder 304*a–d*, 304*k* and 304*l*, and 304*m–p*. In one embodiment, fixed values 330*a–f* each are configured to permit the same rate of fluid flow into and out of corresponding air bladder 304*a–d*, 304*k* and 304*l*, and 304*m–p*. In another embodiment, fixed valves 330 of at least one support zone 324 of support zones 324*a–d* is configured to permit a different rate of fluid flow into and out of the corresponding bladders 304, such that the at least one support zone is inflatable to a different pressure than the remaining support zones. In yet another embodiment, at least one of fixed valves 330*a–f* is replaced with a variable valve wherein the rate of fluid flow into and out of the corresponding bladder 304 is adjustable. In one example, the variable valve is an electronic control valve that is configured to communicate with controller 334 and to adjust the rate of flow based on a signal provided by controller 334.

Three-way valves 332*a* and 332*b* are configured to couple respective air bladders 304*e*, 304*g*, 304*i* and 304*f*, 304*h*, 304*j* to respective supply lines 328*a* and 328*b* in a first orientation and to vent respective air bladders 304*e*, 304*g*, 304*i* and 304*f*, 304*h*, 304*j* to atmosphere in a second orientation. Three-way valves 332*a* and 332*b* are provided in zone 324*b* to permit zone 324*b* to provide a percussion therapy while zones 324*a*, 324*c*, and 324*d* maintain a constant pressure profile or provide an alternating pressure therapy. In a first example, zones 324*a*, 324*c*, and 324*d* are held at a constant pressure profile, although potentially a different pressure profile for each respective zone, and zone 324*b* is configured to provide an alternating pressure therapy or a percussion therapy. In a second example, zones 324*a*, 324*c*, and 324*d* are configured to provide an alternating pressure therapy and zone 324*b* is configured to provide a percussion therapy.

As stated earlier air is supplied to bladders 304*a–p* from supply lines 328*a* and 328*b*. Supply lines 328*a* and 328*b* are coupled to an air supply, such as pump 336, through three-way valves 340*a* and 340*b*, respectively. Any air supply and three-way valves 340*a* and 340*b* known to one skilled in the art of mattresses and hospital equipment can be provided for the operation of the present invention. Three-way valves 340*a* and 340*b* are configured to couple corresponding main supply lines 328*a* and 328*b* to air supply 336 in a first orientation and to couple corresponding main supply lines 328*a* and 328*b* to atmosphere in a second orientation. When pump 336 is coupled to at least one of supply lines 328*a* and 328*b*, the pressure in the at least one of supply lines 328*a* and 328*b* is proportional to the output of pump 336. Pressure sensors 344*a* and 344*b* monitor the pressure in the respective supply lines 328*a* and 328*b*.

Controller 334 is configured to control the operation of pump 336, three-way valves 332*a* and 332*b*, and three-way valves 340*a* and 340*b*. Further, if any of fixed valves 330*a–f* are variable valves, such as electronic control valves, controller 334 can control the variable valve. Further, pressure sensors 344*a* and 344*b* are connected to controller 334 such that controller 334 can monitor the pressure of supply lines 328*a* and 328*b*. In one example, pressure sensors (not shown) are provided between bladders 304*a–p* and valves 330*a–f* and 332*a* and 332*b* such that controller 334 can monitor the pressure of the air supplied to air bladders 304*a–p*. In another example, pressure sensors (not shown) are provided in the interior of at least one of air bladders 304*a–p* such that controller 334 can monitor the pressure inside the at least one of air bladders 304*a–p*. Exemplary controllers, valves, pressure sensors, and overall air pressure systems are shown in U.S. Pat. No. 6,212,718 issued on Apr. 10, 2002 to Stolpmann et al. titled "Air-Over-Foam Mattress" and in the PrimeAire® Therapy Surface sold by Hill-Rom located in Batesville, Ind. and at 4349 Corporate Road, Charleston, S.C. 29405.

Controller 334 is further configured to control fan 320, such that fan 320 is configured to force air through tube 322 into the interior region between cover 312 and impermeable sheet 310. Portion 315 of cover 312 is made from a moisture vapor permeable material that allows air and moisture to pass there through. The air entering the interior region from fan 320 is forced through spacing structure 308 and portion 315 to provide a low air loss therapy wherein a person being supported by support 300 is cooled due to the movement of air. The controller 334 maintains the proper amount of air movement provided by fan 320.

In an alternate embodiment, fixed valves 330*a–f* are replaced with three-way valves similar to three-way valves 332*a* and 332*b*. As such, each air bladder 304*a–p*, under the direction of controller 334 may individually be coupled to a supply line of pressurized air such as 328*a* or coupled atmosphere.

In a further alternate embodiment, fixed valves 330*a–f* and three-way valves 332*a* and 332*b* are replaced with check valves and control orifices which are configured to control the supply of air to each air bladder 304*a–p*. Further, each air bladder is connected to an exhaust line which is coupled to atmosphere. An exemplary configuration of check valves, control orifices and exhaust lines is provided in U.S. Pat. No. 5,794,288 to Soltani et al. titled "Pressure Control Assembly for an Air Mattress, the disclosure of which is herein expressly incorporated by reference.

FIG. 14 further shows a power supply 342 configured to supply electrical power to drive support 300. In the illustrated embodiment, power supply 342 is connected to controller 334 and from controller 334 provides the power for the rest of the system, including fan 320 and pump 336. In another embodiment power supply 342 is directly connected to at least one additional component, such as pump 336 or fan 320.

Although support 300 has illustratively been shown as having four support zones 324*a–d*, it is within the scope of the present invention to have only a single support zone spanning the length of support 300. In one example, the single support zone provides a constant pressure profile across air bladders 304*a–p*. In another example, the single support zone provides an alternating pressure therapy wherein either every other, every third, or other multiples of air bladders 304*a–p* are plumbed together.

Referring to FIGS. 15–18, an exemplary embodiment of patient support software 360 is shown. Patient support software 360 is configured to be executed by controller 334 in association with the operation of support 300.

Figure 15:
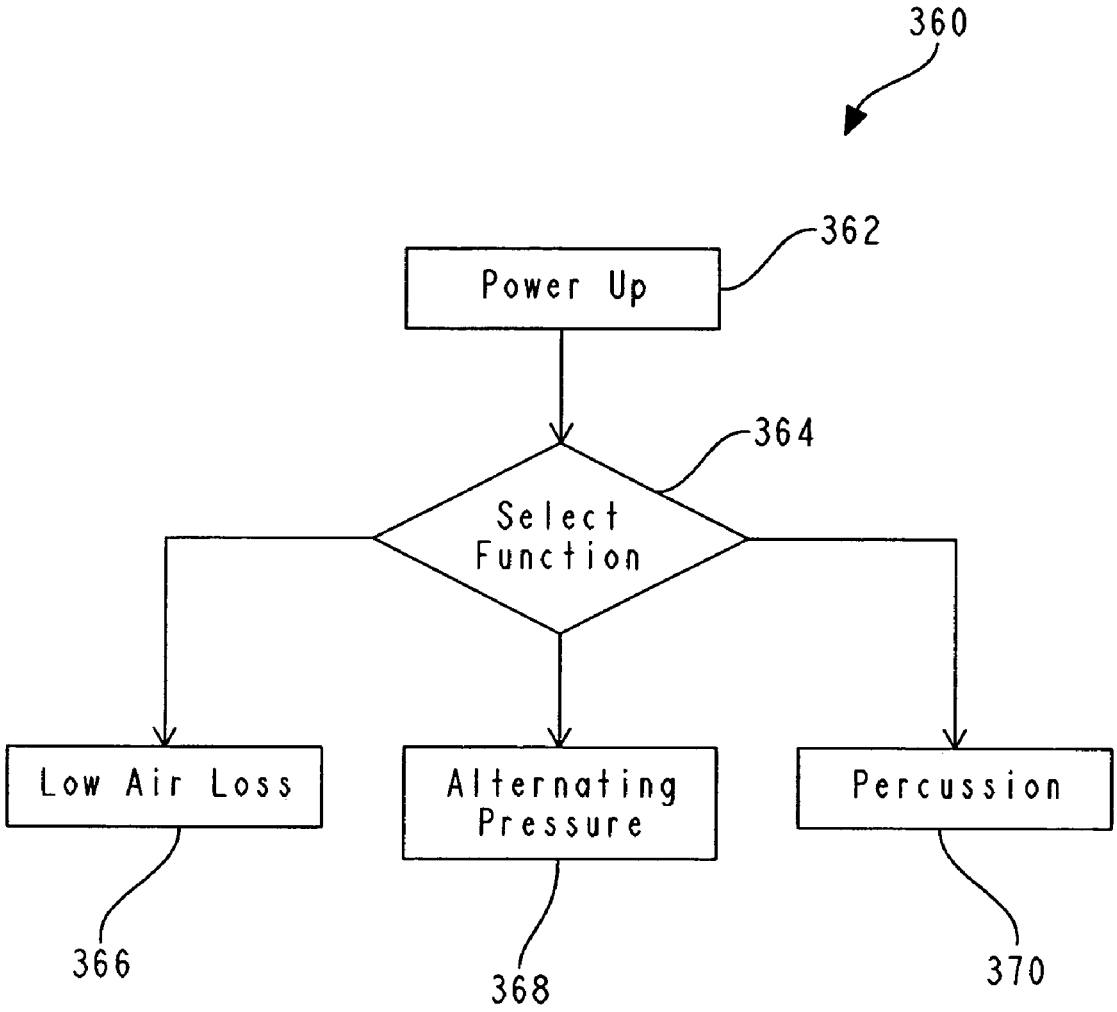
FIGS. 15–18 are flowcharts corresponding to a first exemplary patient support program to be executed by a controller of the support shown in FIGS. 13 and 14.

Referring to FIG. 15, controller 334 and support 300 are turned on or powered up, as represented by block 362. As represented by block 364, the operator is able to selects at least one of three therapies: a low air loss therapy 366, an alternating pressure therapy 368, or a percussion therapy 370. In one example it is possible to select multiple therapies, such that alternating pressure therapy 368 and low air loss therapy 366 are executed simultaneously or such that percussion therapy 370 and low air loss therapy 366 are executed simultaneously. In an alternative embodiment percussion therapy 370 is substituted by a rotational therapy (not shown). In order to provide a rotational therapy, air bladders 304*a–p* of support 300 are divided into two sets of air bladders, right side air bladders (not shown) and left side air bladders (not shown). Exemplary air bladders for use with a rotational therapy, are shown in U.S. Pat. No. 4,949,414 issued Aug. 21, 1990 to Thomas et al. titled "Modular Low Air Loss Patient Support System and Methods for Automatic Patient Turning and Pressure Point Relief," the disclosure of which is herein expressly incorporated by reference and U.S. Pat. No. 6,415,814 issued on Jul. 9, 2002 to Barry D. Hand et al. and titled "Vibratory Patient Support System," the disclosure of which is herein expressly incorporated by reference.

Figure 16:
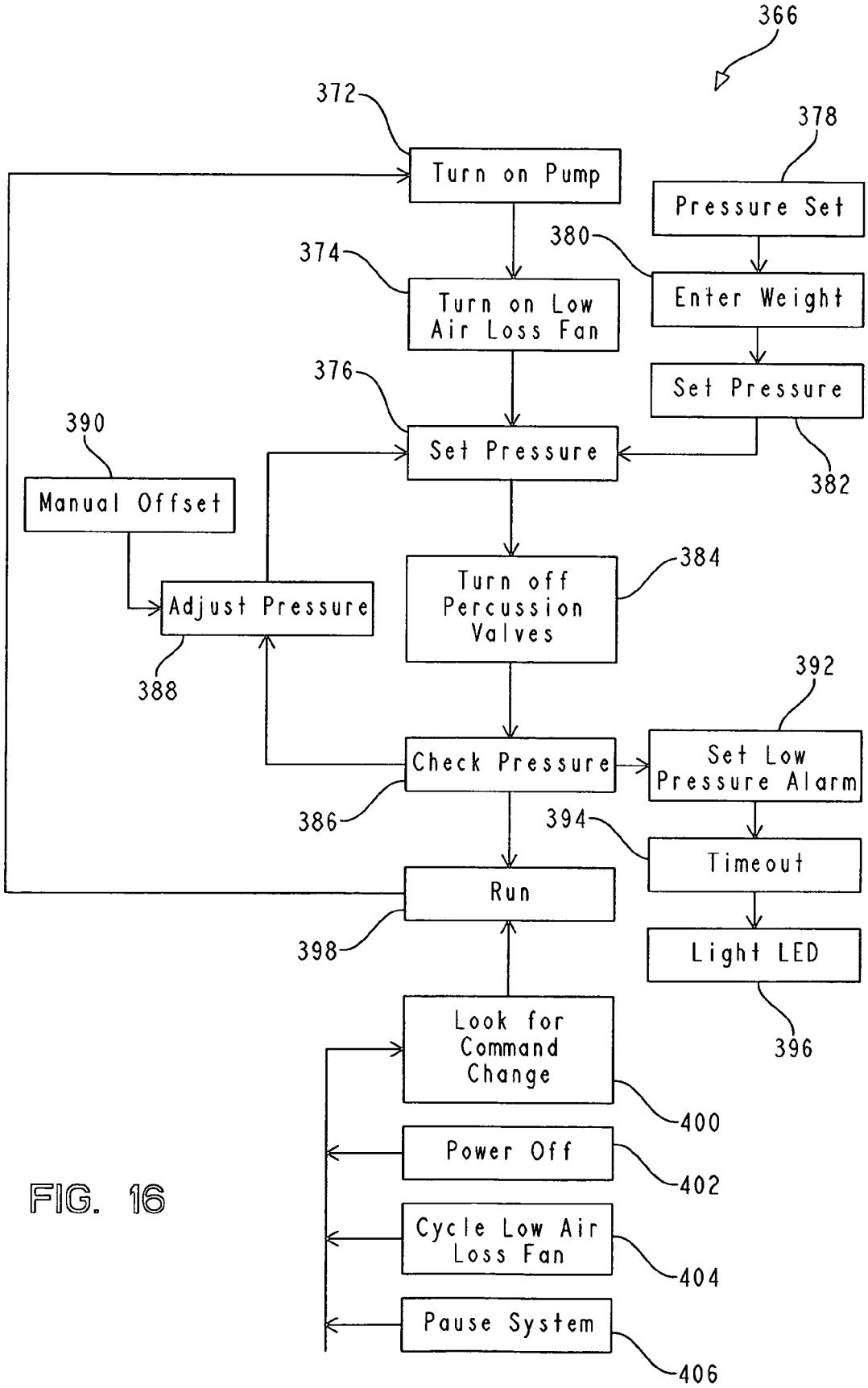

Referring to FIG. 16, a first exemplary low air loss therapy routine 366 is shown. As represented by block 372, controller 334 turns on pump at block 364 such that bladders 304*a–p* are inflated to a start-up pressure profile stored in controller 334. Additionally, fan 320 is activated with initial settings stored in controller, as represented by block 374. The pressure of bladders 304*a–p* are set such that a pressure profile is established or stored, as represented by block 376. The terms "pressure profile" are used to refer to the fact that the pressure in each support zone 324*a–d* may be different because of the different support requirements of that particular zone. For example, the pressure in the support zone corresponding to the feet of the body may be lower than one or more of the other support zones to provide pressure relief to the heel of the body.

In one example, the pressure profile is determined based on input from a caregiver. A caregiver selects a pressure set input from a caregiver interface (not shown) connected to support 300, as represented by block 378. The caregiver enters the weight of the patient lying on support 300, as represented by block 380, and controller 334 through an algorithm sets the appropriate pressure profile, as represented by block 382. An example of setting of a pressure profile based on at least the weight of a patient in a support having multiple support zones and a caregiver interface are shown in U.S. Pat. No. 4,949,414 issued Aug. 21, 1990 to Thomas et al. titled "Modular Low Air Loss Patient Support System and Methods for Automatic Patient Turning and Pressure Point Relief," the disclosure of which is herein expressly incorporated by reference and U.S. Pat. No. 6,415,814 issued on Jul. 9, 2002 to Barry D. Hand et al. and titled "Vibratory Patient Support System," the disclosure of which is herein expressly incorporated by reference.

Once the pressure for each support zone 324*a–d* is set by controller 334 through the operation of pump 336, valves 330*a–f*, valves 332*a* and 332*b*, and valves 340*a* and 340*b*, controller 334 checks to determine if percussion control valves 332*a* and 332*b* need to be turned off, as represented by block 384. Percussion control valves 332*a* and 332*b* are in an on configuration or "turned on" when they are being cycled between the first orientation and the second orientation at a rate that corresponds to percussion therapy 370, as discussed below in connection with blocks 412 and 414 in FIG. 18. Percussion control valves 332*a* and 332*b* are in an off configuration or "turned off" when they are held in either the first orientation or the second orientation, preferably the first orientation wherein air bladders 304*e–j* are connected to respective supply lines 328*a* and 328*b*. However, if low air loss therapy 366 is to be conducted simultaneously with percussion therapy 370, block 384 is disabled.

Controller 334 monitors the pressure profile of bladders 304*a–p*, as represented by block 386. Adjustments to the pressure profile can be made, as represented by block 388. One example adjustment is a manual offset from a patient comfort input, as represented by block 390. For example, an input device such as a control panel (not shown) may be accessed by a patient in order that the patient can either increase the pressure or reduce the pressure in the patient support or in a given zone of the patient support. In another example, adjustments to the pressure profile are made due to a change in the position of the patient on support 300 or the orientation of support 300, such as a head section (not shown) of a bed (not shown) on which support 300 is positioned is tilted upward. Controller 334, as represented by block 376, sets or stores the adjustments to the pressure profile.

If controller 334 detects a low pressure in either supply line 328*a* or 328*b* through pressure sensors 344*a* and 344*b* or a low pressure in at least one of bladders 304*a–p*, a low pressure alarm is set, as represented by block 392. Controller 334 waits for a predefined time interval to see if the pressure is restored to a generally normal level, as represented by block 394. If the pressure has not been restored upon the expiration of the time interval an alarm is initiated, such as the lighting of an LED, as represented by block 396. In other examples the alarm is an audible alarm, a light positioned remote from support 300 such as in the hallway or at a nurse's station, or a signal across a network (not shown) to a caregiver station.

Controller 334 continues to execute the base routine of low air loss therapy 366 in the absence of a change in command, as represented by blocks 398 and 400. In one example, a command change, as represented by block 400 is the selection of another or an additional therapy. Further, example changes in command include a request to power off support 300, as represented by block 402, a request to cycle or turn off the low air loss fan 320, as represented by block 404, and to pause the system, as represented by block 406. In one variation, pausing the system indicates to controller 334 to hold the current pressure in air bladders 304*a–p*. In another variation, pausing the system indicates to controller 334 to adjust the pressure in air bladders 304*a–p* to a stored pressure profile.

Figure 17:
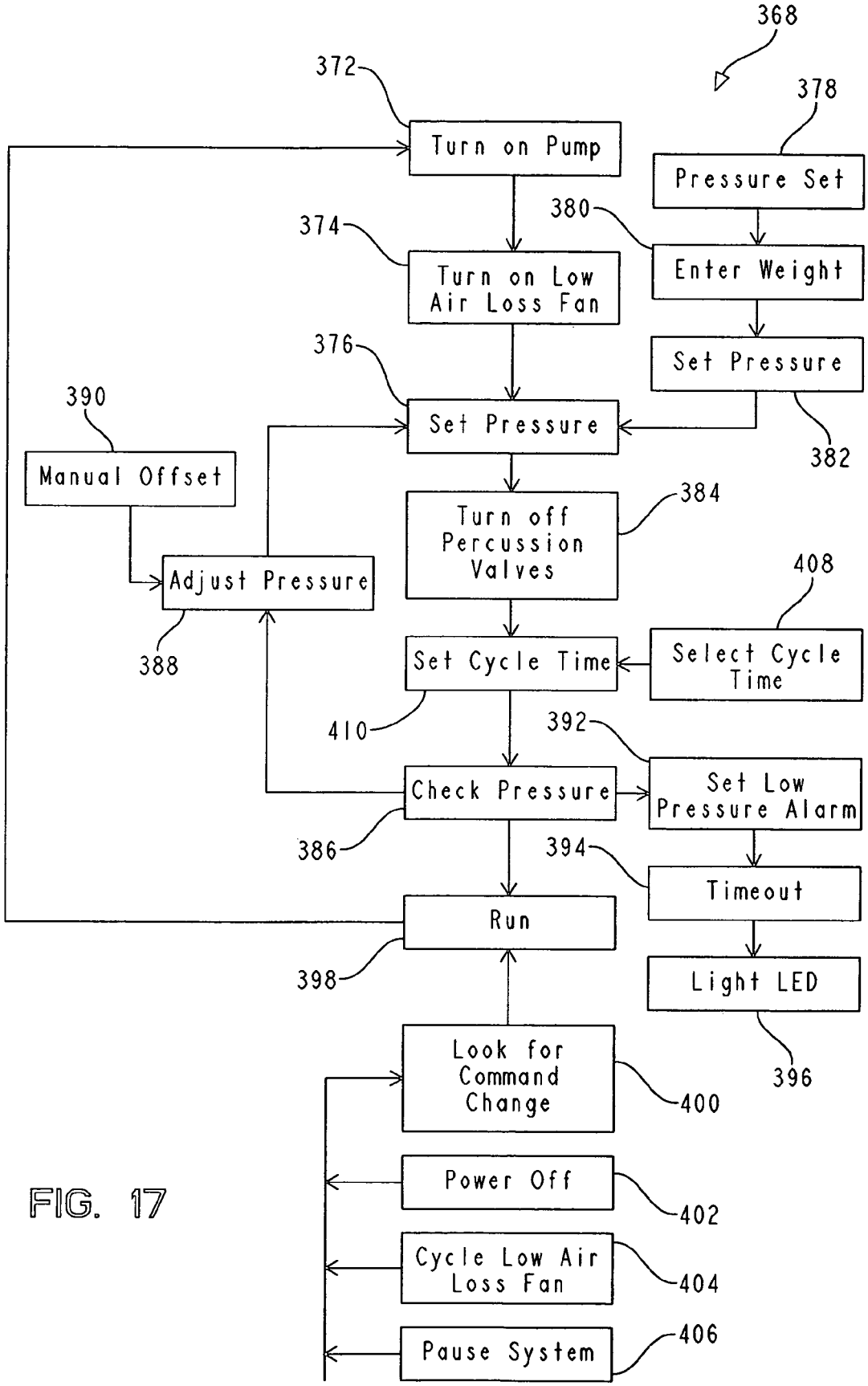

Referring to FIG. 17, a first exemplary alternating pressure therapy routine 368 is shown. Alternating pressure therapy routine 368 is generally similar to low air loss therapy routine 366. As such like numerals are positioned on like blocks that are common to both alternating pressure routine 368 and low air loss routine 366. Further, if alternating pressure therapy 368 is to be conducted simultaneously with percussion therapy 370, block 384 is disabled. Alternating pressure therapy 368 differs from low air loss therapy 366 in that a cycle time is selected, as represented by block 408. Controller 334 sets the cycle time as represented by block 410.

As explained earlier, alternating pressure therapy 368 corresponds to plumbing every second, every third, or higher multiple of air bladders 304*a–p* together to define at least two groups of support bladders. In the illustrated example of FIG. 14, a first bladder group consists of air bladders 304*a*, 304*c*, 304*e*, 304*g*, 304*l*,304*k*, 304*m*, and 304*o* and a second bladder group consists of air bladders 304*b*, 304*d*, 304*f*, 304*h*, 304*j*, 304*l*, 304*n*, and 304*p*.

At the onset of alternating pressure therapy 368, the pressure in the first illustrated bladder group and the second illustrated bladder group corresponds to the stored constant pressure profile for support 300. During a first cycle of alternating pressure therapy the pressure in the first group is adjusted to a higher pressure than the pressure in the second group and then the pressure in the first group is adjusted to a lower pressure than the pressure in the second group. In one example, a first cycle corresponds to in a first step holding the pressure in the first group of air bladders and dropping the pressure in the second group of air bladders to a predetermined pressure profile or by a predetermined percentage of pressure, holding the resultant pressures in the first group and the second group for a first time period in a second step, in a third step restoring the pressure in the second group of air bladders and dropping the pressure in the first group of air bladders, to a predetermined pressure profile or by a predetermined percentage of pressure, holding the resultant pressures for a second time period in a fourth step, and then restoring the pressure in the first group of air bladders and dropping the pressure in the second group of air bladders, such that support 300 is in the configuration provided in step one. Subsequent cycles consist of repeating steps two through five. If the alternating pressure therapy is terminated, the pressure in both the first group of air bladders and the second group of air bladders is restored. In one variation, the first time period and the second time period correspond to about 3 minutes to about 5 minutes.

In another example, a first cycle corresponds to in a first step holding the pressure in the first group of air bladders and elevating the pressure in the second group of air bladders to a predetermined pressure profile or by a predetermined percentage of pressure, holding the resultant pressures in the first group and the second group for a first time period in a second step, in a third step restoring the pressure in the second group of air bladders and elevating the pressure in the first group of air bladders, to a predetermined pressure profile or by a predetermined percentage of pressure, holding the resultant pressures for a second time period in a fourth step, and then restoring the pressure in the first group of air bladders and elevating the pressure in the second group of air bladders, such that support 300 is in the configuration provided in step one. Subsequent cycles consist of repeating steps two through five. If the alternating pressure therapy is terminated, the pressure in both the first group of air bladders and the second group of air bladders is restored. In one variation, the first time period and the second time period correspond to about 3 minutes to about 5 minutes.

In a further example, a first cycle corresponds to in a first step elevating the pressure in the first group of air bladders to a predetermined pressure profile or by a predetermined percentage of pressure and dropping the pressure in the second group of air bladders to a predetermined pressure profile or by a predetermined percentage of pressure, holding the resultant pressures in the first group and the second group for a first time period in a second step, in a third step elevating the pressure in the second group of air bladders to a predetermined pressure profile or by a predetermined percentage of pressure and dropping the pressure in the first group of air bladders to a predetermined pressure profile or by a predetermined percentage of pressure, holding the resultant pressures for a second time period in a fourth step, and then elevating the pressure in the first group of air bladders to a predetermined pressure profile or by a predetermined percentage of pressure and dropping the pressure in the second group of air bladders to a predetermined pressure profile or by a predetermined percentage of pressure, such that support 300 is in the configuration provided in step one. Subsequent cycles consist of repeating steps two through five. If the alternating pressure therapy is terminated, the pressure in both the first group of air bladders and the second group of air bladders is restored. In one variation, the first time period and the second time period correspond to about 3 minutes to about 5 minutes.

Figure 18:
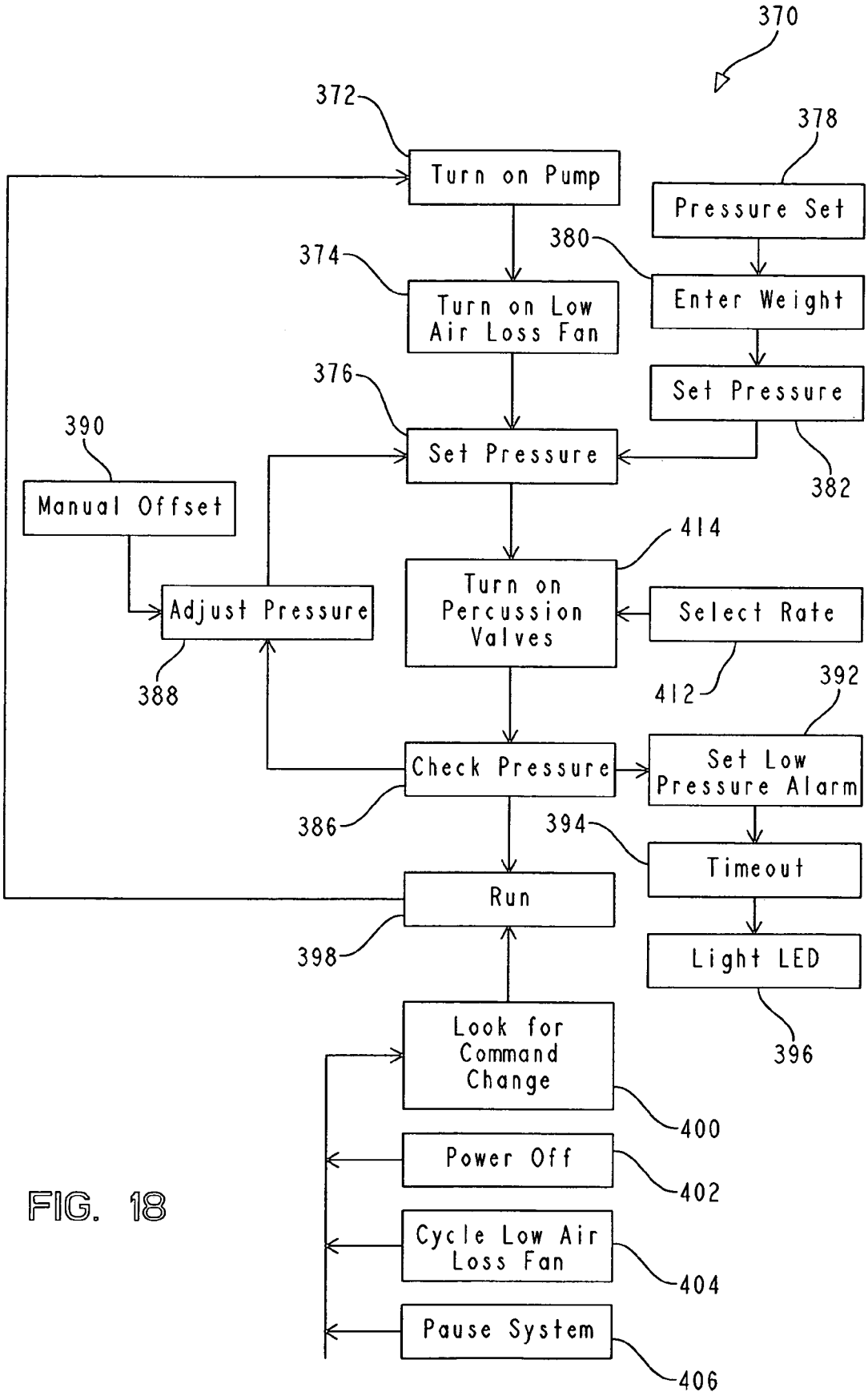

Referring to FIG. 18, a first exemplary percussion therapy routine 370 is shown. Percussion therapy routine 370 is generally similar to low air loss therapy routine 366 and alternating pressure therapy routine 368. As such like numerals are positioned on like blocks that are common to percussion therapy routine 370 and both alternating pressure routine 368 and low air loss routine 366. Percussion therapy routine 370 differs from low air loss therapy 366 in that a percussion rate is selected, as represented by block 412. Controller 334 turns on percussion valves 332*a* and 332*b* and initiates the percussion therapy, as represented by block 414.

In a first example, three-way valves 332*a* and 332*b* are configured to couple respective air bladders 304*e*, 304*g*, 304*i* and 304*f*, 304*h*, 304*j* to respective supply lines 328*a* and 328*b* in a first orientation and to vent respective air bladders 304*e*, 304*g*, 304*i* and 304*f*, 304*h*, 304*j* to atmosphere in a second orientation. In a first step three-way valve 332*a* couples air bladders 304*e*, 304*g* and 304*i* to supply line 328*a* and three-way valve 332*b* couples air bladders 304*f*, 304*h* and 304*j* to atmosphere to quickly reduce the pressure in air bladders 304*f*, 304*h* and 304*j*. In a second step, three-way valve 332*a* couples air bladders 304*e*, 304*g* and 304*i* to atmosphere to quickly reduce the pressure in air bladders 304*e*, 304*g* and 304*i* and three-way valve 332*b* couples air bladders 304*f*, 304*h* and 304*j* to supply line 328*b* to pressurize air bladders 304*f*, 304*h* and 304*j*. In one variation, the rate selected for the percussion therapy corresponds to cycling between the first orientation and the second orientation at about 1 Hertz to about 25 Hertz, at about 1 Hertz to about 5 Hertz, and at about 6 Hertz to about 25 Hertz.

In another example, air bladders 304*e–j*, include vibrating means configured to provide percussion therapy. In one variation, the vibrating means are disposed within air bladders 304*e–j*. In another variation, the vibrating means disposed partially within air bladders 304*e–j* and partially as a portion of top portion 314 of air bladders 304*e–j*. Exemplary vibrating means are shown in U.S. Pat. No. 4,949,414 issued Aug. 21, 1990 to Thomas et al. titled "Modular Low Air Loss Patient Support System and Methods for Automatic Patient Turning and Pressure Point Relief," the disclosure of which is herein expressly incorporated by reference and U.S. Pat. No. 6,415,814 issued on Jul. 9, 2002 to Barry D. Hand et al. and titled "Vibratory Patient Support System," the disclosure of which is herein expressly incorporated by reference.

What is claimed is:

1. An apparatus configured to support at least a portion of a body thereon, the apparatus comprising:

an inflatable first layer including a plurality of support zones;

a second layer positioned between the inflatable first layer and the portion of the body to be supported, the second layer including a spacing structure;

an impermeable sheet configured to be impermeable to fluids and moisture, the impermeable sheet disposed between the inflatable first layer and the second layer;

a cover configured to couple to the impermeable sheet, the cover including a first portion positioned adjacent the portion of the body to be supported, the first portion including a moisture vapor permeable material; and a controller configured to control the pressure in each support zone of the plurality of support zones of the inflatable first layer, the inflatable first layer configured to provide a static support surface wherein a first support zone is configured to be generally pressurized at a first pressure and a second support zone is configured to be generally pressurized at a second pressure, the second pressure differing from the first pressure.

2. The apparatus of claim 1, wherein the first support zone generally corresponds to the head of the body to be supported and the second support zone generally corresponds to the feet of the body to be supported.

3. The apparatus of claim 1, wherein each of the plurality of support zones includes a plurality of bladders.

4. The apparatus of claim 3, wherein the inflatable first layer is configured to provide at least one therapy to the portion of the body supported thereon.

5. The apparatus of claim 4, wherein at least one of the support zones of the inflatable first layer is configured to provide a percussion therapy.

6. The apparatus of claim 5, wherein the plurality of bladders of the at least one support zone configured to provide percussion therapy are inflated and deflated at a rate of between about 1 Hertz to about 25 Hertz.

7. The apparatus of claim 4, wherein at least one of the support zones of the inflatable first layer is configured to provide an alternating pressure therapy.

8. The apparatus of claim 6, wherein all of the support zones of the inflatable first layer are configured to provide an alternating pressure therapy.

9. The apparatus of claims 1, wherein the spacing structure includes a three dimensional engineered material having a plurality of resilient members.

10. The apparatus of claims 1, wherein the spacing structure includes indented fiber networks.

11. The apparatus of claim 1, wherein the cover is coupled to a source of air to provide air circulation through the second layer and the through the moisture vapor permeable material of the first portion of the cover.

12. The apparatus of claim 11, further comprising a heating element to provide heat to at least a portion of the body supported thereon.

13. The apparatus of claim 12, wherein the heating element is controlled by the controller.

14. The apparatus of claim 1, wherein one of the covers and the impermeable sheet is coupled to the inflatable first layer.

15. An apparatus configured to support at least a portion of a body thereon, the apparatus comprising:

an inflatable first layer including a plurality of support zones, the plurality of support zones including a first support zone which generally corresponds to the chest region of the body;

a second layer positioned between the first layer and the portion of the body to be supported, the second layer comprising a spacing structure;

a controller configured to control the pressure of each support zone of the first inflatable layer and further to control the pressure of the first support zone to provide a percussion therapy to the chest region of the body;

a cover positioned between the second layer and the portion of the body to be supported, the cover including a moisture vapor permeable material; and an impermeable sheet configured to be impermeable to fluids and moisture, the impermeable sheet disposed between the first layer and the second layer.

16. The apparatus of claim 15, wherein the cover defines an interior region, the second layer being positioned within the interior region.

17. The apparatus of claim 16, further comprising a source of air coupled to the cover such that air is forced through the second layer.

18. The apparatus of claim 15, wherein the cover defines an interior region, the second layer being positioned within the interior region, and at least a portion of a top surface of the cover is made from the moisture vapor permeable material, the portion of the top surface and the second layer cooperating to provide cooling for the body supported on the portion of the top surface.

19. The apparatus of claim 18, further comprising a source of air coupled to the cover to provide air circulation through the second layer.

20. The apparatus of claim 15, wherein the inflatable first layer is further configured to provide an alternating pressure therapy.

21. The apparatus of claim 15, wherein the inflatable first layer is further configured to provide a rotational therapy.

22. The apparatus of claim 15, wherein the spacing structure includes a three dimensional engineered material having a plurality of resilient members.

23. The apparatus of claim 15, wherein the spacing structure includes indented fiber networks.

24. The apparatus of claim 15, wherein one of the cover and the impermeable sheet is coupled to the inflatable first layer.

25. An apparatus configured to support at least a portion of a body thereon, the apparatus comprising:

a base portion including an inflatable first layer having a plurality of support zones, each zone having associated support characteristics;

a pressure distribution layer supported by at least a first zone of the base portion, the pressure distribution layer including a spacing structure configured to provide air passage therethrough and to distribute pressure from the body over a greater area of the first zone;

a cover positioned between the pressure distribution layer and the portion of the body to be supported, the cover being coupled to a first source of air to provide air circulation through the pressure distribution layer, the cover including a first portion made from a moisture vapor permeable material, the first portion of the cover and the pressure distribution layer cooperating to provide cooling to the body;

an impermeable sheet configured to be impermeable to fluids and moisture, the impermeable sheet disposed between the base portion and the pressure distribution layer; and a controller configured to control the pressure in each support zone of the plurality of support zones of the inflatable first layer.

26. The apparatus of claim 25, wherein the inflatable first layer includes a plurality of inflatable bladders, each of the plurality of support zones including at least one of the plurality of bladders.

27. The apparatus of claim 26, wherein the controller controls the pressure of the plurality of bladders of at least the first support zone to provide alternating pressure therapy to the body.

28. The apparatus of claim 26, wherein the first support zone generally supports the chest region of the body and the controller controls the pressure of the plurality of bladders of at least the first support zone to provide percussion therapy to the chest region of the body.

29. The apparatus of claim 28, wherein the plurality of bladders of the at least one support zone configured to provide percussion therapy are inflated and deflated at a rate of between about 1 Hertz to about 25 Hertz.

30. The apparatus of claim 26, wherein the controller controls the pressure of the plurality of bladders of at least the first support zone to provide rotational therapy to the body.

31. The apparatus of claim 26, further comprising a heating element to provide heat to at least a portion of the body supported thereon.

32. The apparatus of claim 31, wherein the heating element is controlled by the controller.

33. The apparatus of claim 25, wherein the base portion is coupled to a second source of air, the amount of air received by the pressure distribution layer from the first source of air and the amount of air received by the base portion from the second source of air being controlled by the controller.

34. The apparatus of claim 25, wherein the pressure distribution layer is supported by each zone of the base portion and is positioned in an interior region of the cover.

35. The apparatus of claim 32, wherein the base portion is positioned in the interior region of the cover.

36. The apparatus of claim 25, wherein the spacing structure includes a three dimensional engineered material having a plurality of resilient members.

37. The apparatus of claim 25, wherein the spacing structure includes indented fiber networks.

38. The apparatus of claim 25, wherein at least one support zone of the base portion includes a foam portion.

39. The apparatus of claim 25, wherein one of the cover and the impermeable sheet is coupled to the base portion.

* * * * *